US008359797B2

(12) United States Patent
Lee

(10) Patent No.: US 8,359,797 B2
(45) Date of Patent: Jan. 29, 2013

(54) STRUCTURE CONSTRUCTED USING PRECAST MEMBERS AND METHOD OF CONSTRUCTING THE SAME

(76) Inventor: Wan Young Lee, Seoul (KR)

( * ) Notice: Subject to any disclaimer, the term of this patent is extended or adjusted under 35 U.S.C. 154(b) by 426 days.

(21) Appl. No.: 12/674,386

(22) PCT Filed: Nov. 30, 2007

(86) PCT No.: PCT/KR2007/006128

§ 371 (c)(1),
(2), (4) Date: Feb. 19, 2010

(87) PCT Pub. No.: WO2009/025421

PCT Pub. Date: Feb. 26, 2009

(65) Prior Publication Data

US 2011/0131908 A1 Jun. 9, 2011

(30) Foreign Application Priority Data

Aug. 21, 2007 (KR) ..... 10-2007-0083960

(51) Int. Cl.
*E04B 1/04* (2006.01)
*E04B 1/41* (2006.01)

(52) U.S. Cl. ..... 52/259; 52/236.8; 52/236.9; 52/266; 52/272; 52/281; 52/283; 52/79.11; 249/19

(58) Field of Classification Search ..... 52/236.5, 52/236.6, 236.8, 236.9, 251, 259, 266, 272, 52/281, 283, 432, 79.11, 79.14
See application file for complete search history.

(56) References Cited

U.S. PATENT DOCUMENTS 3,300,943 A * 1/1967 Owens ..... 52/745.11
3,775,928 A * 12/1973 Dawson et al. ..... 52/745.13
3,897,663 A * 8/1975 Gaul ..... 52/136
3,948,008 A * 4/1976 Goetz ..... 52/73
4,018,021 A * 4/1977 Dow ..... 52/251
4,147,009 A * 4/1979 Watry ..... 52/742.15

(Continued)

FOREIGN PATENT DOCUMENTS

FR 2850409 7/2004
JP 2-85450 * 3/1990

(Continued)

OTHER PUBLICATIONS

International Search Report for PCT/KR2007/006128 mailed Apr. 3, 2008.

*Primary Examiner* — Robert Canfield
(74) *Attorney, Agent, or Firm* — Christopher Paul Mitchell

(57) ABSTRACT

The present invention provides a structure constructed using PC members and a method of constructing the structure. In the present invention, each of PC wall members (10) of PC walls (1) has connection reinforcing bars (11) at predetermined positions. Each of PC slab members (20) of PC slabs (2) has open reinforcing bars (21), which protrude from the PC slab member (20). Supporting molds (3) are mounted to the PC wall members (10) at positions just below the connection reinforcing bars (11), so that the PC slab members (20) are placed on the supporting molds (3), such that the connection reinforcing bars (11) are overlapped with the corresponding open reinforcing bars (21) in slab areas, and connection concrete (4) is cast at a construction site such that the connection reinforcing bars (11) and the open reinforcing bars (21) are embedded in the connection concrete (4), thus integrating the PC walls (1) and the PC slabs (2) with each other.

23 Claims, 28 Drawing Sheets

U.S. PATENT DOCUMENTS

| | | | | | |
|---|---|---|---|---|---|
| 4,398,378 | A * | 8/1983 | Heitzman | 52/251 |
| 4,616,459 | A * | 10/1986 | Shubow | 52/309.12 |
| 5,881,527 | A | 3/1999 | Haseotes | |
| 6,223,480 | B1 * | 5/2001 | Khoo | 52/79.9 |
| 7,661,231 | B2 * | 2/2010 | Dalton | 52/236.8 |
| 2001/0039773 | A1 * | 11/2001 | Bot | 52/259 |
| 2005/0220539 | A1 | 10/2005 | Yee | |
| 2010/0146872 | A1 * | 6/2010 | Klersy | 52/79.11 |

FOREIGN PATENT DOCUMENTS

| | | | |
|---|---|---|---|
| JP | 2004-270285 | * | 9/2004 |
| JP | 2007-063927 | | 3/2007 |

* cited by examiner

Fig. 4
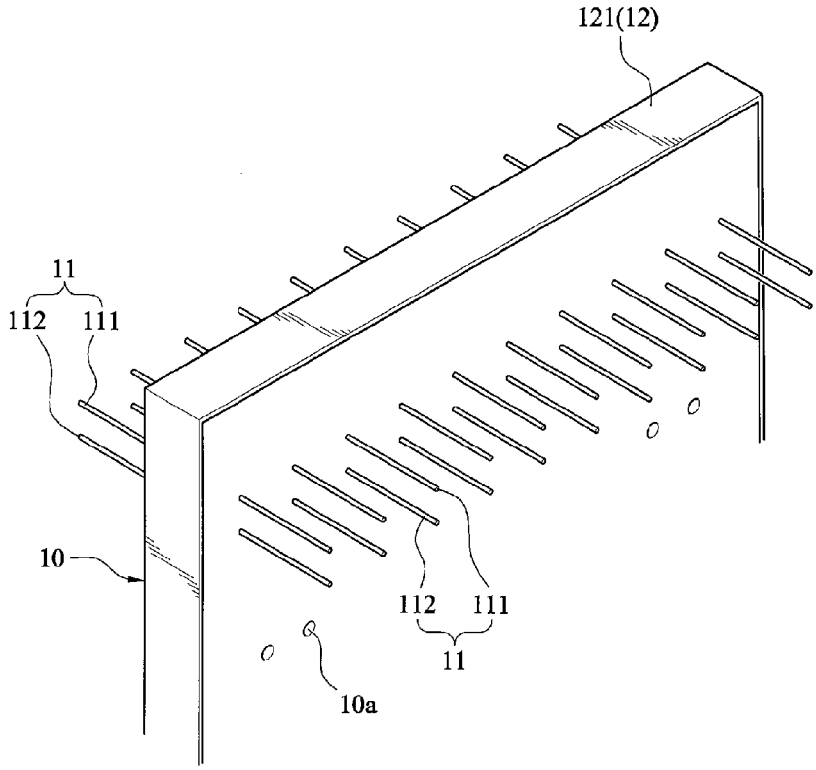
[Fig. 5
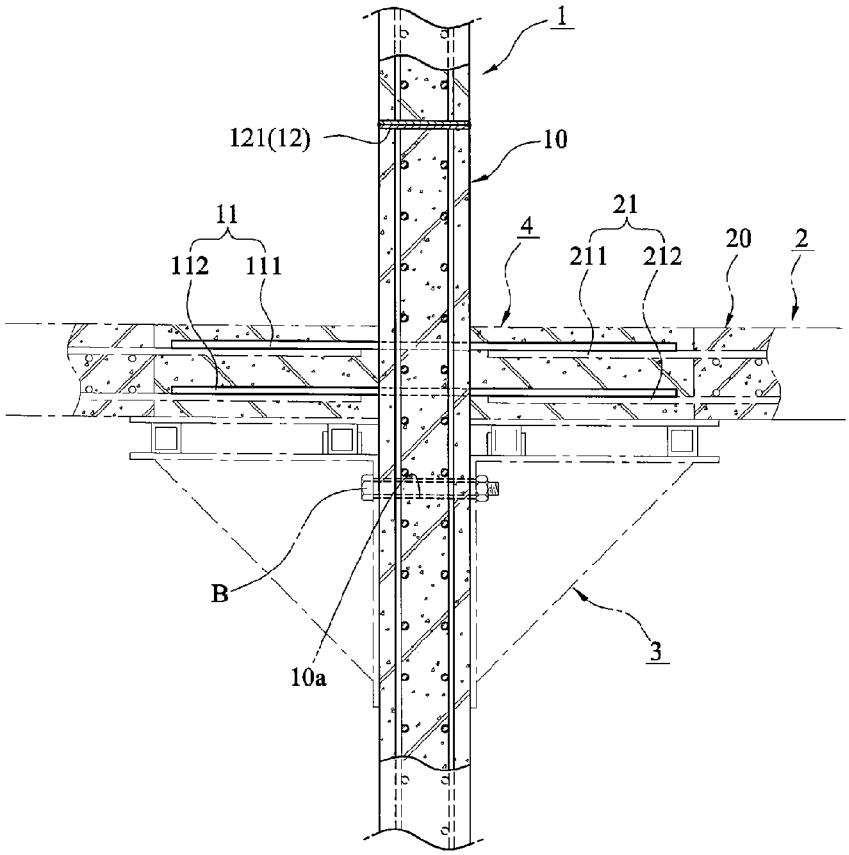

STRUCTURE CONSTRUCTED USING PRECAST MEMBERS AND METHOD OF CONSTRUCTING THE SAME

RELATED APPLICATIONS

This application is a 371 application of International Application No. PCT/KR2007/006128, filed Nov. 30, 2007, which in turn claims priority from Korean Patent Application No. 10-2007-0083960, filed Aug. 21, 2007, both of which are incorporated herein by reference in their entireties.

TECHNICAL FIELD

The present invention relates, in general, to the construction of structures, such as apartment buildings and office buildings, and, more particularly, to a structure constructed using PC (precast) members, in which PC walls and PC slabs are integrated with each other using connection concrete in slab areas, and a method of constructing such a structure.

BACKGROUND ART

Recently, a method of constructing a structure using PC members, which are manufactured in a factory and carried to a construction site, was proposed and has been effectively used at construction sites to construct apartment buildings and office buildings.

For example, a representative conventional technique pertaining to the construction of a structure using PC members was proposed in Korean Patent Laid-Open Publication No. 1998-068760 (date: Oct. 26, 1998), which was entitled 'COUPLING STRUCTURE BETWEEN PC WALL AND PC SLAB OF STRUCTURE AND CONSTRUCTION METHOD THEREOF'.

In this conventional technique, lower PC wall panels, each of which has on the upper end thereof an upper connection part from which the ends of wall reinforcing bars protrude upwards, are installed. Thereafter, a half PC slab panel is horizontally placed on the upper ends of the adjacent lower PC wall panels. At this time, mounting parts of slab reinforcing bars, which extend outwards from the opposite ends of the half PC slab panel, are coupled to the upper connection parts of the adjacent lower PC wall panels, thus integrating the half PC slab panel with the lower PC wall panels. Subsequently, an upper PC wall panel is coupled to the upper end of each lower PC wall panel. At this time, a lower connection part, which is provided on the lower end of the upper PC wall panel, and from which the ends of wall reinforcing bars protrude downwards, is overlapped with and welded to the upper connection part of the lower PC wall panel, thus integrating the upper PC wall panel with the lower PC wall panel. At a construction site, fresh concrete is cast in a reinforcing bar coupling portion, in which the connection parts and the mounting parts are coupled to each other, and fresh concrete is cast on the upper surface of each half PC slab panel to form an integrated location-cast concrete plate.

As such, in the technique disclosed in the above publication, the upper and lower connection parts of the wall reinforcing bars, which are embedded in the upper and lower PC wall panels, are integrated with each other by welding in the overlapped state and are welded to the mounting parts of the slab reinforcing bars, which are embedded in the half PC slab panels. Thereafter, the reinforcing bar coupling portions, in which the upper and lower connection parts and the mounting parts are coupled to each other, are filled with concrete, and the location-cast concrete plates are formed on the upper surface of the half PC slab panels by applying concrete thereon. Therefore, a structure having a relatively large space therein and having relatively few stories can be constructed using only the PC walls and the PC slabs, without using separate posts or cross beams. Furthermore, the upper and lower PC wall panels and the half PC slab panel can be integrated with each other more securely, thus ensuring the satisfactory strength of the structure.

However, the conventional technique has the following disadvantages. First, because the conventional technique has a complex construction, in which the upper and lower connection parts of the wall reinforcing bars of the upper and lower PC wall panels and the mounting parts of the slab reinforcing bars of the half PC slab panels are gathered at one junction, that is, in the reinforcing bar junction, the work of constructing the PC walls and the PC slabs is more difficult, thus markedly reducing construction efficiency. In addition, it is difficult to completely pour fresh concrete into every portion of the reinforcing bar junction, at which the upper and lower connection parts of the wall reinforcing bars of the upper and lower PC wall panels and the slab reinforcing bars of the half PC slab panels are complicatedly coupled to each other. Thus, an opening may be undesirably formed in the cross-section of the reinforcing bar junction, with the result that the structural strength is decreased.

Second, the conventional technique uses a construction method in which, after the half PC slab panels are placed on the lower PC wall panels, the upper PC wall panels are coupled to respective lower PC wall panels coupled to the PC slab panels. Therefore, from the lowermost story to the uppermost story, the structure must be sequentially constructed using the PC walls and the PC slabs one story after another. As a result, there is a problem in that the time required to construct the structure using the PC members is excessively increased.

DISCLOSURE OF INVENTION

Technical Problem

Accordingly, the present invention has been made keeping in mind the above problems occurring in the prior art, and an object of the present invention is to provide a structure constructed using PC members in which ranges of junctions between PC walls and PC slabs are dispersed into areas of corresponding slabs, thus making construction easy and enhancing construction quality, and a method of constructing the structure.

Another object of the present invention is to provide a structure constructed using PC members, in which several stories of PC slabs can be coupled to PC walls at the same time, so that construction can be rapidly undertaken, thus reducing the construction time and costs, thereby realizing economical construction, and a method of constructing the structure.

Technical Solution

In order to accomplish the above objects, in an aspect, the present invention provides a structure constructed using PC (precast) members, the structure being constructed by forming PC walls using PC wall members, which are placed upright at predetermined positions, and by forming PC slabs for partitioning floors using PC slab members, which are horizontally provided between the PC wall members of the PC walls, wherein the PC wall members of the PC walls comprise a plurality of connection reinforcing bars, which horizontally protrude from the PC wall members at positions at which slabs, forming multiple stories, are constructed, each of the PC slab members of the PC slabs is shorter than a distance between the PC walls and comprises open reinforcing bars, which protrude from edge surfaces of the PC slab member that are opposite each other in a longitudinal direction, and supporting molds are mounted to the PC wall members at respective positions just below the connection reinforcing bars, which protrude from the PC wall members, so that the PC slab members of the PC slabs are placed on the corresponding supporting molds such that the connection reinforcing bars of the PC wall members of the PC walls are overlapped with the corresponding open reinforcing bars of the PC slab members of the PC slabs in slab areas, and connection concrete is cast at a construction site such that the connection reinforcing bars of the PC wall members and the open reinforcing bars of the PC slab members are embedded in the connection concrete, thus integrating the PC walls and the PC slabs with each other through the connection concrete in the slab areas.

In another aspect, the present invention provides a method of constructing a structure using PC members through a process of forming PC walls using PC wall members, which are placed upright at predetermined positions, and of forming PC slabs for partitioning floors using PC slab members, which are horizontally provided between the PC wall members of the PC walls, the method comprising: a PC wall constructing step of consecutively placing upright the PC wall members, each having a plurality of connection reinforcing bars, which horizontally protrude from the PC wall member at a position at which the corresponding PC slab member is coupled to the PC wall member, thus forming the PC walls; a support mold mounting step of removably mounting supporting molds to the PC walls at positions just below the connection reinforcing bars protruding from the PC wall members; a PC slab constructing step of placing the PC slab members, each having open reinforcing bars that are shorter than a distance between the adjacent PC walls and protrude from opposite edge surfaces of the PC slab members, on the corresponding supporting molds, such that the open reinforcing bars of the PC slab members are overlapped with the corresponding connection reinforcing bars of the PC wall members in slab areas, thus forming the PC slabs; and a connection concrete forming step of casting connection concrete at a construction site such that the connection reinforcing bars of the PC wall members of the PC walls and the open reinforcing bars of the PC slab members of the PC slabs are embedded in the connection concrete in the overlapped state, so that the PC walls and the PC slabs are integrated with each other in the slab areas through the connection concrete.

Advantageous Effects

In a structure constructed using PC members and a method of constructing the structure according to the present invention, connection reinforcing bars, which protrude from PC wall members of PC walls, and open reinforcing bars, which extend from PC slab members of PC slabs, are overlapped and integrated with each other in slab areas by connection concrete, which is cast at a construction site. Therefore, the range of a junction between each PC wall and the corresponding PC slab is prevented from being concentrated at one position, but is dispersed over the area of the corresponding slabs. Thus, working conditions for conducting the operation of coupling the PC slabs to the PC walls are improved, and construction efficiency is improved.

Furthermore, the range within which the connection reinforcing bars of the PC wall members and the open reinforcing bars of the PC slab members are overlapped with each other is relatively large, so that connection concrete to be cast at a construction site can be fully and closely charged into the reinforcing bar junction, thus preventing an opening from being formed in the cross-section of the reinforcing bar junction. Therefore, there is an advantage in that the structural strength of the junctions between the PC walls and the PC slabs is enhanced.

In addition, in the present invention, the PC slabs are coupled to the PC walls by a construction method in which connection concrete is cast at a construction site using supporting molds, which are removably mounted to the PC wall members of the PC walls at corresponding positions, in a state in which the PC slab members of the PC slabs are supported on the corresponding supporting molds. Hence, the PC slab members of the PC slabs can be coupled to the PC wall members of the PC walls at the same time, so that the construction time can be markedly reduced, and, as well, a process of installing wooden concrete forms, which is a major factor that increases the amount of work in the conventional technique, is not required when the PC slabs are coupled to the PC walls, thus reducing the number of workers and construction costs.

BRIEF DESCRIPTION OF THE DRAWINGS

FIGS. 4 and 5 are views showing connection reinforcing bars which protrude from a PC wall member, according to the embodiment of the present invention;

BEST MODE FOR CARRYING OUT THE INVENTION

Figure 1:
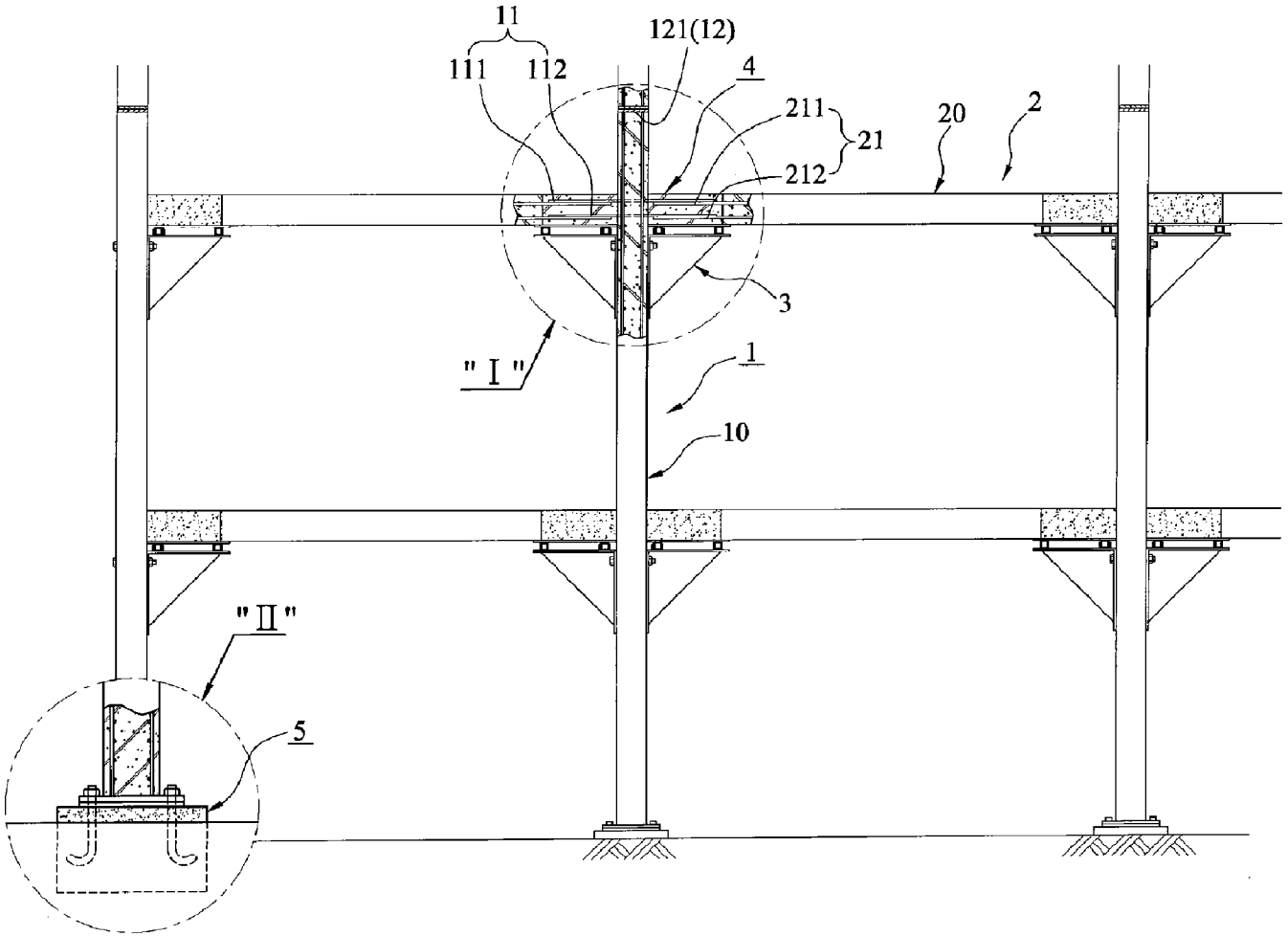
FIG. 1 is a partially broken front view of a structure constructed using PC members, according to an embodiment of the present invention.

Hereinafter, a structure constructed using PC (precast) members according to a preferred embodiment of the present invention will be described in detail with reference to the attached drawings.

The structure constructed using the PC members according to the present invention includes PC walls 1, each of which is constructed using PC wall members 10, PC slabs 2, each of which is constructed using PC slab members 20, supporting molds 3, which are removably mounted to the PC wall members 10 of the PC walls 1, and connection concrete 4, which couples the PC walls 1 to the corresponding PC slabs 2.

Figure 2:
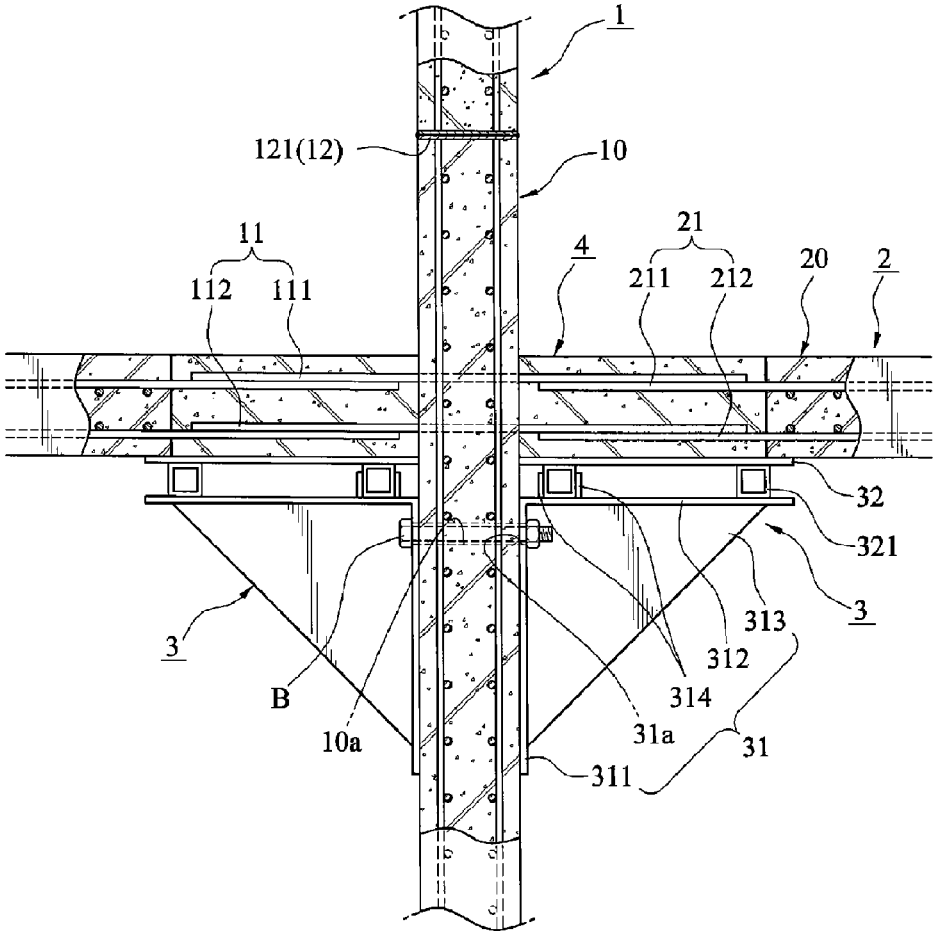
FIG. 2 is an enlarged sectional view of a circled portion "I" of FIG. 1.
Figure 3:
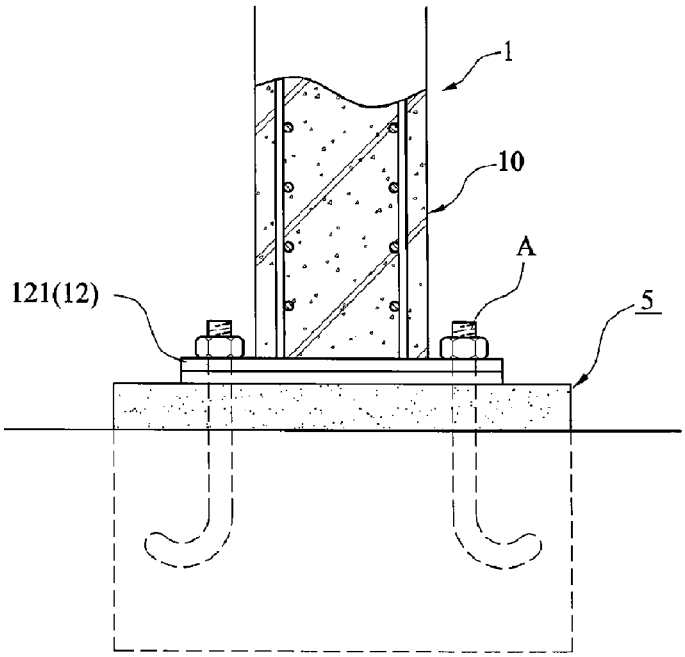
FIG. 3 is an enlarged sectional view of a circled portion "II" of FIG. 1.

As shown in FIGS. 1 through 3, each PC wall 1 is constructed by consecutively placing the PC wall members 10 on top of one another on a corresponding base 5, which is previously constructed at a given construction position.

Every PC wall member 10 is a concrete plate body, which is produced in a factory. Each PC wall member 10 has connection reinforcing bars 11, which extend in horizontal directions, at every position at which the corresponding PC slab member 20 is coupled to the PC wall member 10. The connection reinforcing bars 11 of each PC wall member 10 overlap with open reinforcing bars 21 of the corresponding PC slab member 20 and are embedded at a construction site in connection concrete 4, which couples the PC wall 1 and the PC slab 2 to each other, thus forming a slab.

Here, of the PC walls 1, each of the PC wall members 10 of PC walls 1, which become inside walls, includes connection reinforcing bars 11, which horizontally extend through the PC wall member in opposite directions, such that the PC slabs 2 are coupled to the PC wall on opposite sides of the PC wall. Furthermore, of the PC walls 1, each of the PC wall members 10 of PC walls 1, which become outside walls, includes connection reinforcing bars 11, which horizontally extend from the PC wall member in one direction such that the PC slab 2 is coupled to the inner surface of the outside PC wall.

As shown in FIGS. 4 and 5, in the embodiment of the present invention, the connection reinforcing bars 11 comprise upper and lower connection reinforcing bars 111 and 112, which horizontally protrude from each PC wall member 10 and are arranged in widthwise directions. The upper and lower connection reinforcing bars 111 and 112 are overlapped with the open reinforcing bars 21 of the corresponding PC slab member 20 of the PC slab 2 and are embedded in connection concrete 4 which is cast at a construction site to couple the PC wall 1 and the PC slab 2 to each other, thus structurally reinforcing the connection concrete.

Figure 6:
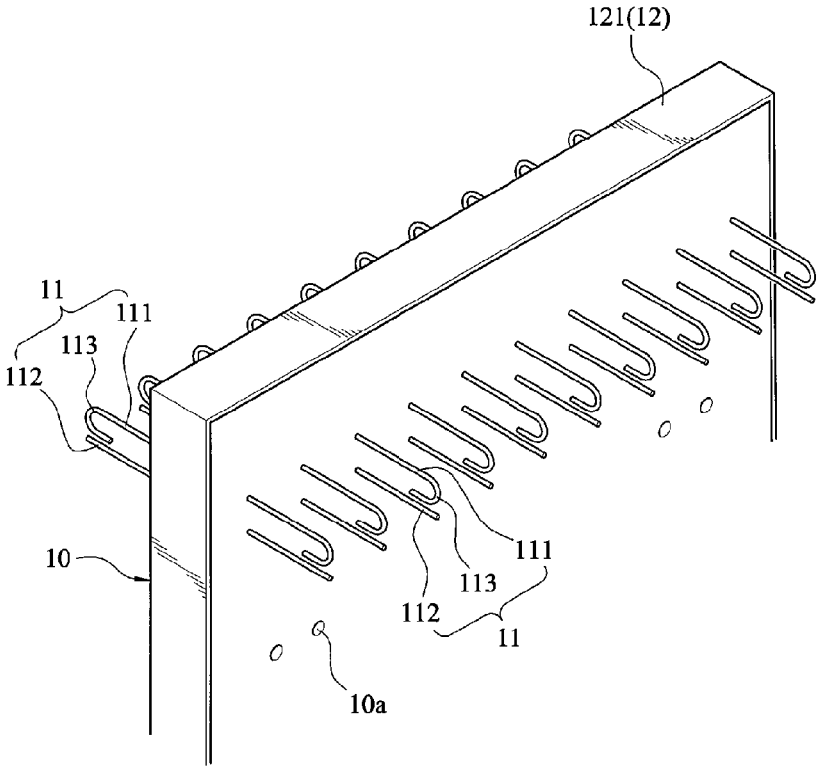
FIGS. 6 and 7 are views showing a modification of the connection reinforcing bars which protrude from the PC wall member, according to the embodiment of the present invention.
Figure 7:
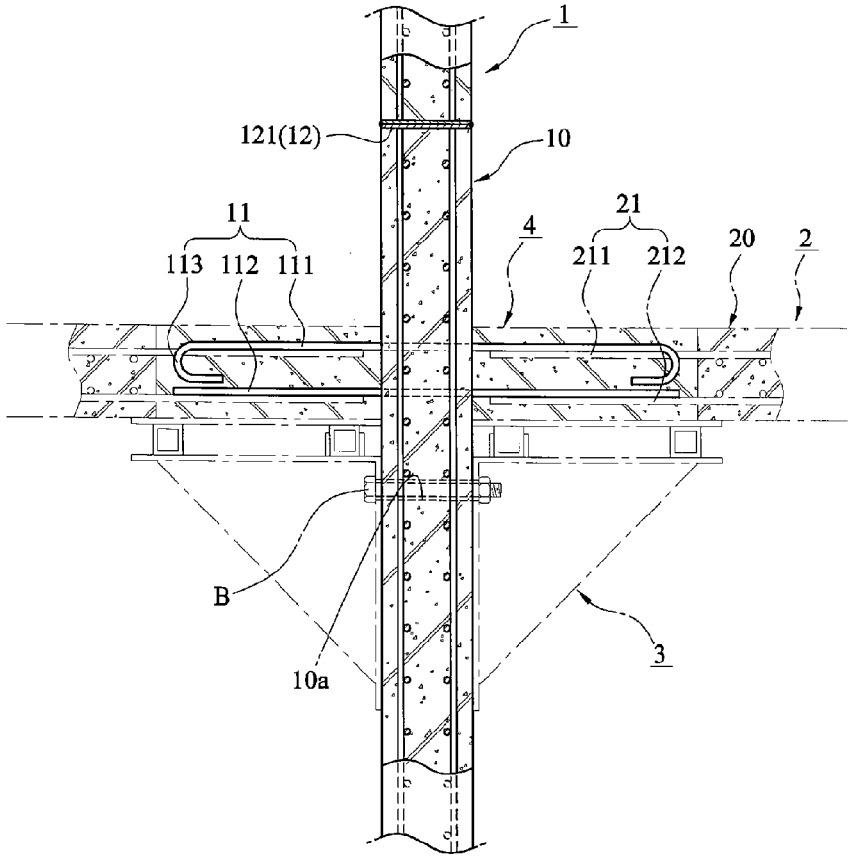

As shown in FIGS. 6 and 7, illustrating a modification of the embodiment, the connection reinforcing bars 11 comprise upper and lower connection reinforcing bars 111 and 112, which horizontally protrude from each PC wall member 10 and are arranged in widthwise directions, and each upper connection reinforcing bar 111 may have on the end thereof a bent part 113, which is curved downwards to form a hook shape. Alternatively, as shown in FIGS. 8 and 9, illustrating another modification of the embodiment, the connection reinforcing bars 11 comprise upper and lower connection reinforcing bars 111 and 112, which horizontally protrude from each PC wall member 10 and are arranged in widthwise directions, and both of the upper and lower connection reinforcing bars 111 and 112 may have on the ends thereof bent parts 113, which are bent at right angles.

As such, in the modifications, the bent parts 113 are formed on the ends of the connection reinforcing bars 11, so that the lengths to which the connection reinforcing bars 11 protrude from the PC wall member 10 are reduced, thus making the PC wall member 10 easy to carry and handle. Furthermore, when the PC wall members 10 are moved, deformation of the connection reinforcing bars 11 attributable to contact with other objects is minimized, and a worker is prevented from being injured by the ends of the connection reinforcing bars 11.

Figure 8:
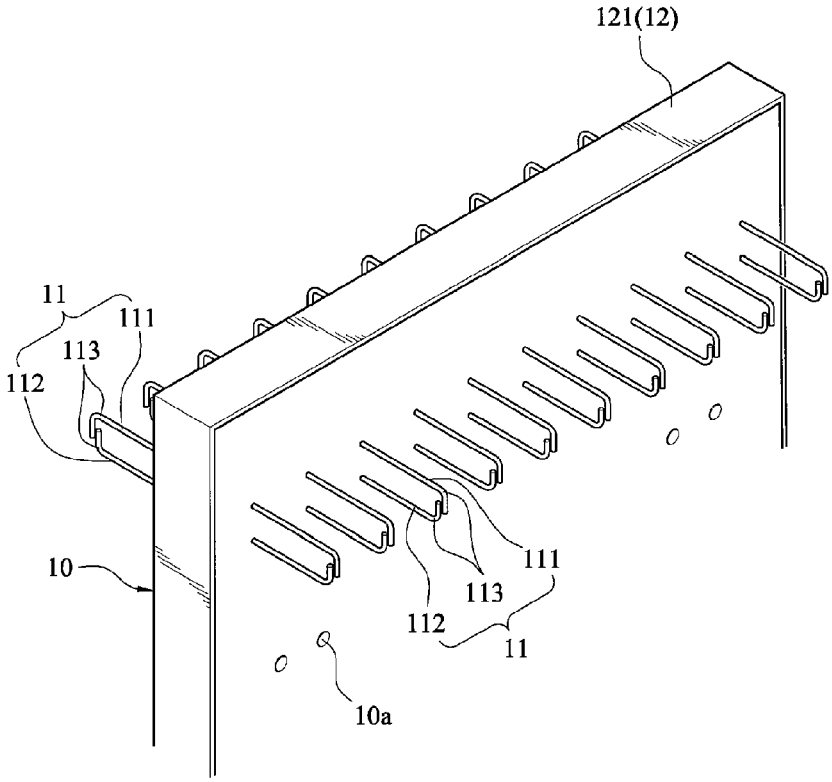
FIGS. 8 through 10 are views showing another modification of the connection reinforcing bars which protrude from the PC wall member and showing bolt holes, according to the present invention.
Figure 9:
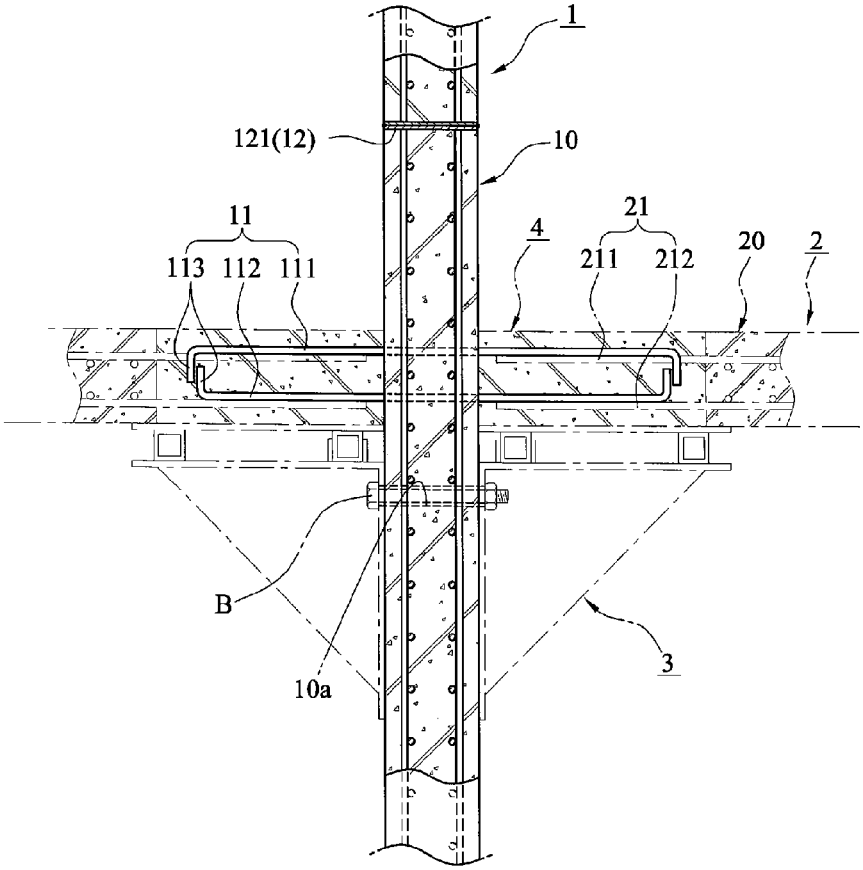
Figure 10:
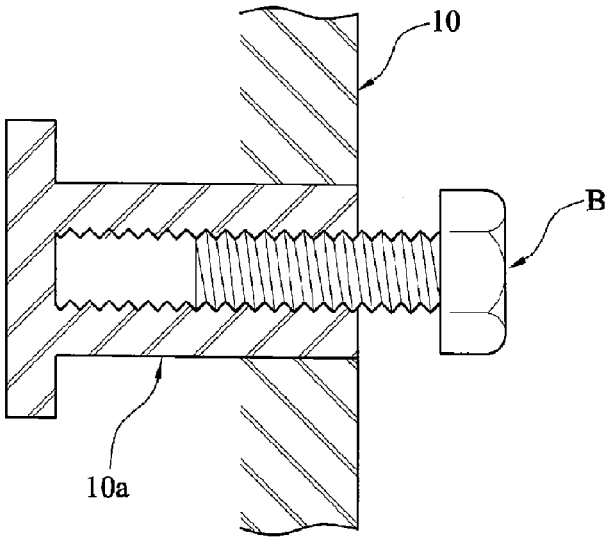

As shown in FIGS. 8 through 10, each PC wall member 10 has a plurality of bolt holes just below the connection reinforcing bars 11. The supporting mold 3 is mounted to the PC wall member through the bolt holes by a bolt coupling method.

Here, an internal thread may be formed in each bolt hole 10*a*, such that a bolt can be tightened into the bolt hole 10*a* without a separate nut.

Figure 11:
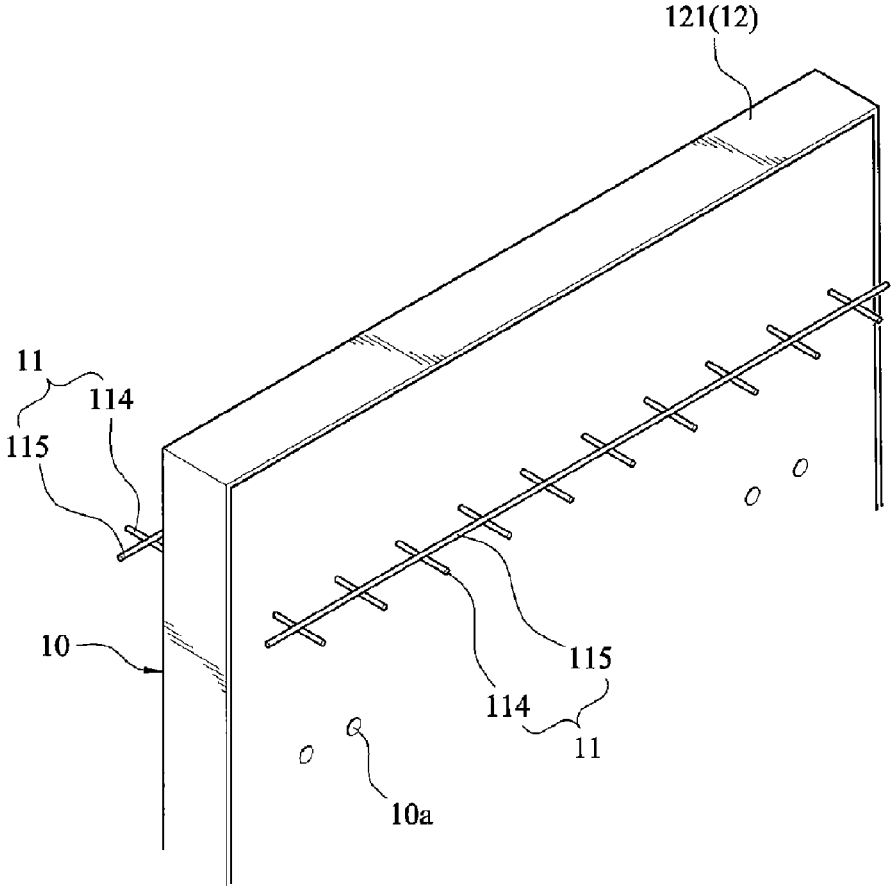
FIGS. 11 and 12 are views showing another modification of the connection reinforcing bars which protrude from the PC wall member according to the present invention.
Figure 12:
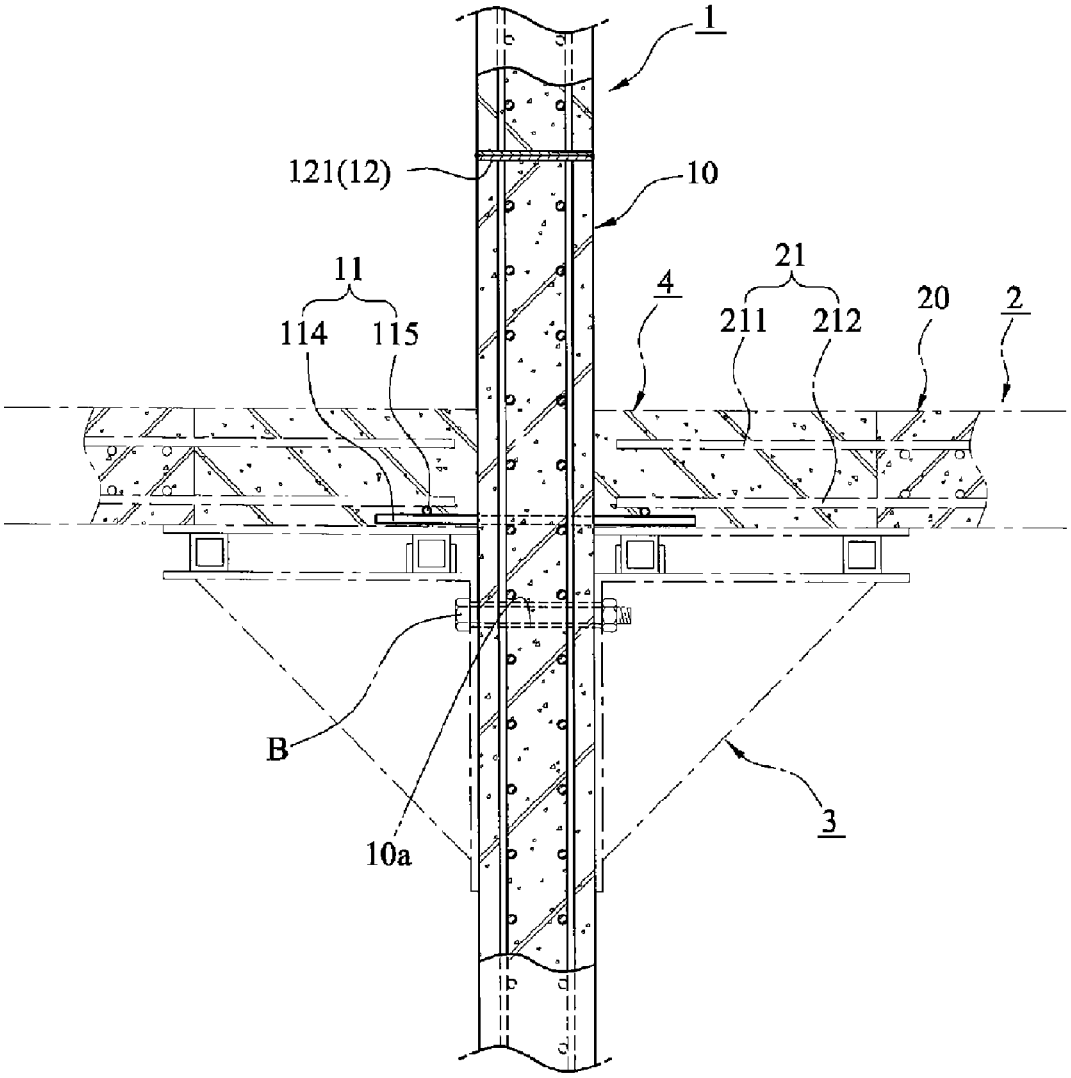

FIGS. 11 and 12 are views showing another modification of the connection reinforcing bars. In this case, the connection reinforcing bars 11 comprise stud bars 114, which protrude from the outer surface of the PC wall member 10 below the position at which the corresponding PC slab member 20 is coupled to the PC wall member 10.

In detail, the connection reinforcing bars 11 according to this modification comprise the stud bars 114, which perpendicularly protrude from the outer surface of the PC wall member 10, and a bearing bar 115, which crosses the stud bars 114. The stud bars 114 and the bearing bar 115 are overlapped with the open reinforcing bars 21 of the corresponding PC slab member 20 of the PC slab 2 and are embedded in connection concrete 4, which is cast at a construction site, to couple the PC wall 1 and the PC slab 2 to each other, thus reinforcing the connection concrete 4 such that the connection concrete 4 can resist shear force generated by a vertical load.

Meanwhile, each PC wall member 10 includes an iron wall connection frame 12, so that the adjacent PC wall members 10 can be consecutively connected to each other through the iron wall connection frames 12 by butt-jointing.

Figure 13:
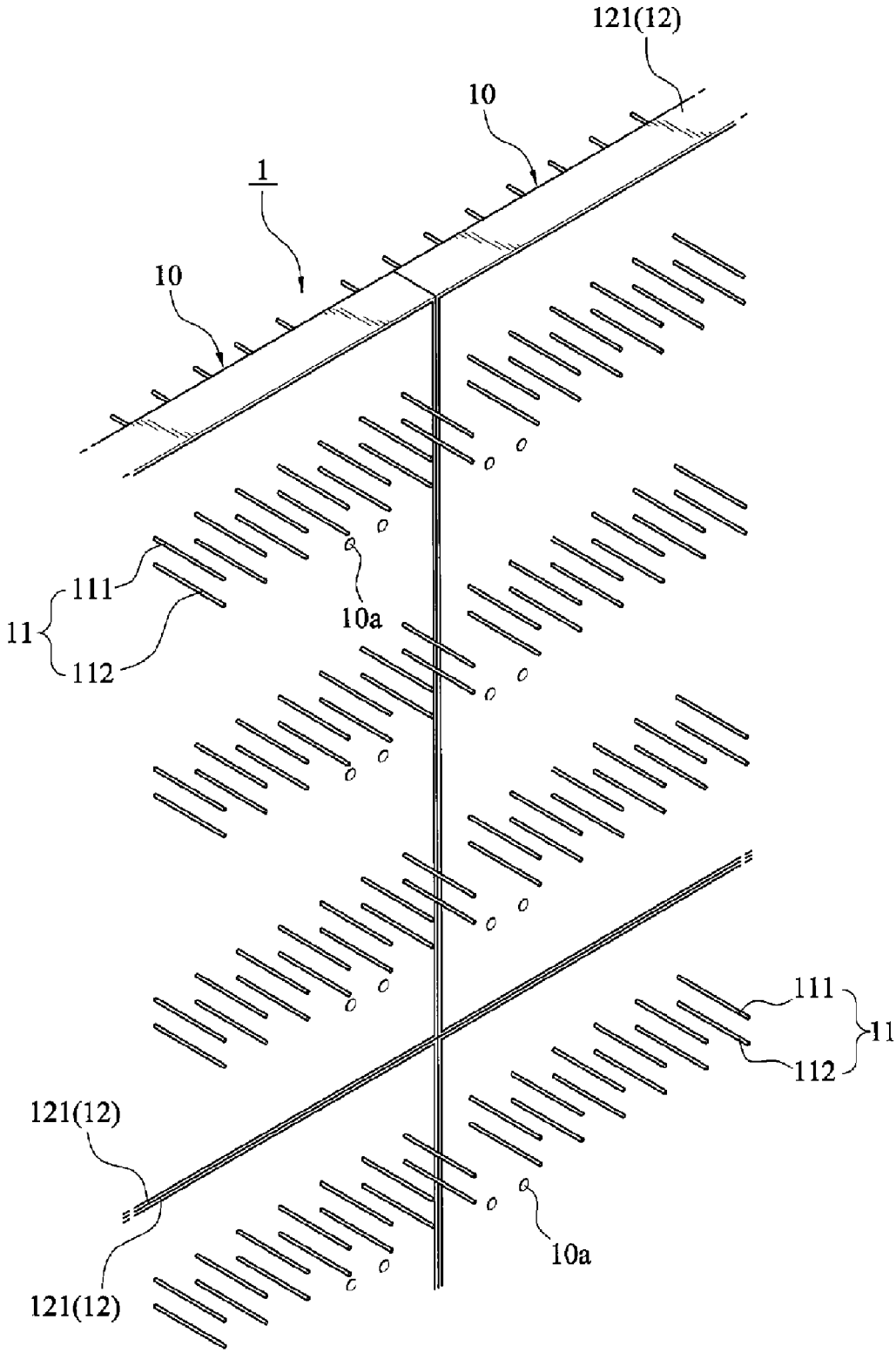
FIGS. 13 and 14 are views showing an iron wall connection frame provided on the PC wall member according to the embodiment of the present invention.
Figure 14:
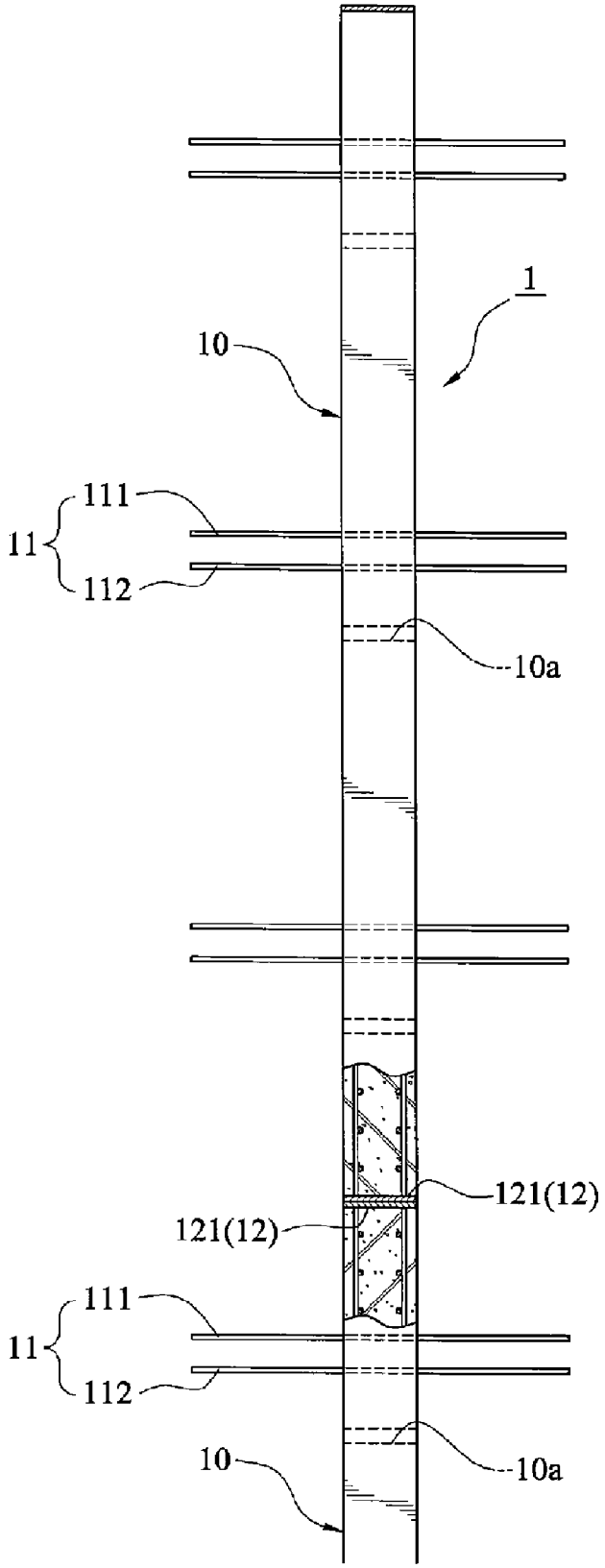

In the embodiment of the present invention, as shown in FIGS. 13 and 14, the iron wall connection frame 12 comprises a planar iron plate 121, which is integrally provided along the edge surfaces of each PC wall member 10. Thus, the adjacent PC wall members 10 are coupled to each other by butt-joint welding through the iron wall connection frames 12, which comprise the planar iron plates 121.

Here, a planar iron plate 121 that is relatively wide is provided under the lower end of each of the lowermost PC wall members 10 of the PC wall 1. The wide planar iron plates 121 are brought into close contact with and are securely fastened to the upper surface of the corresponding base 5 by anchor bolts A in order to reliably support the PC wall 1 on the base 5.

Figure 15:
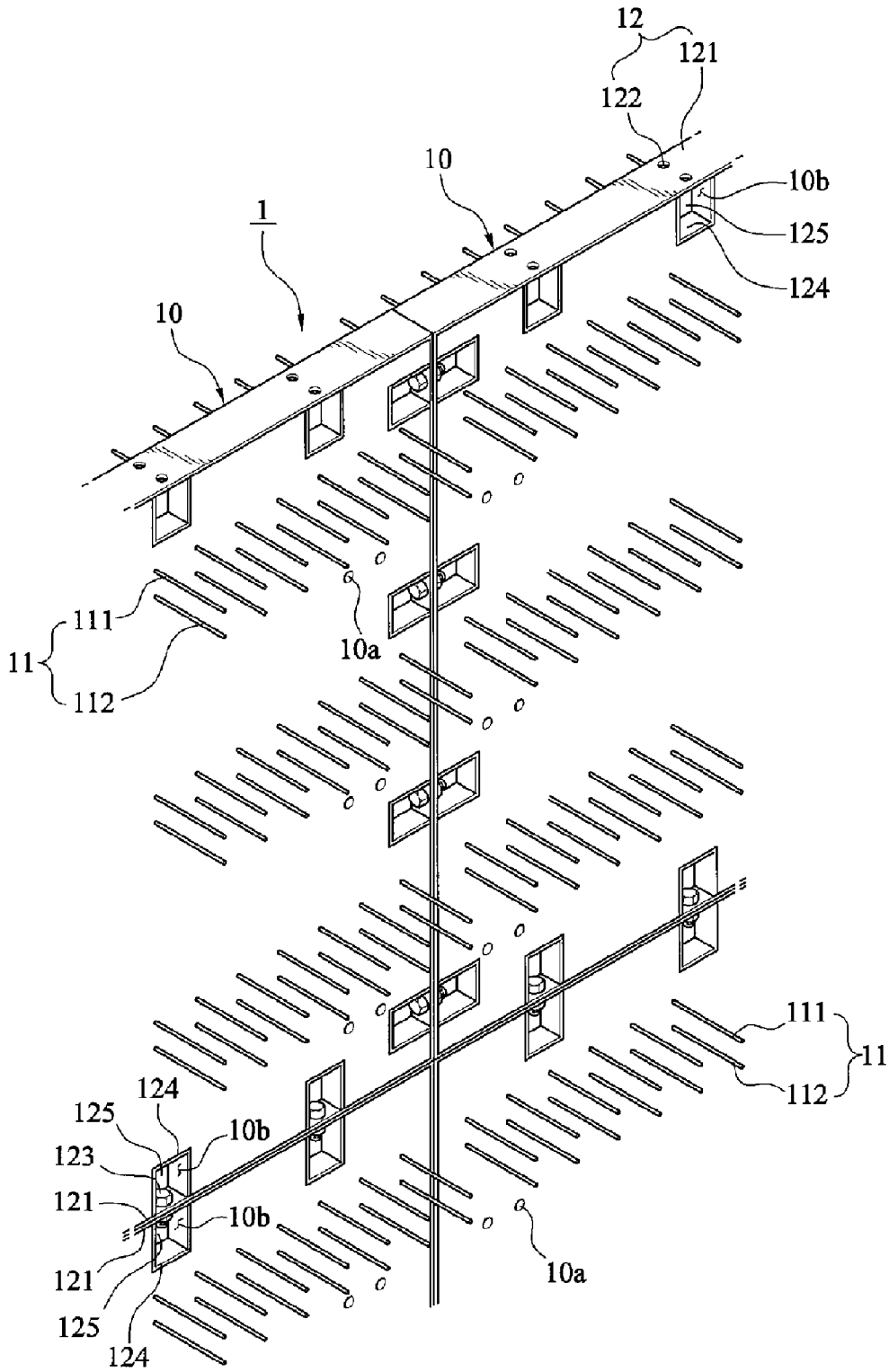
FIGS. 15 and 16 are views showing a modification of the iron wall connection frame provided on the PC wall member according to the embodiment of the present invention.
Figure 16:
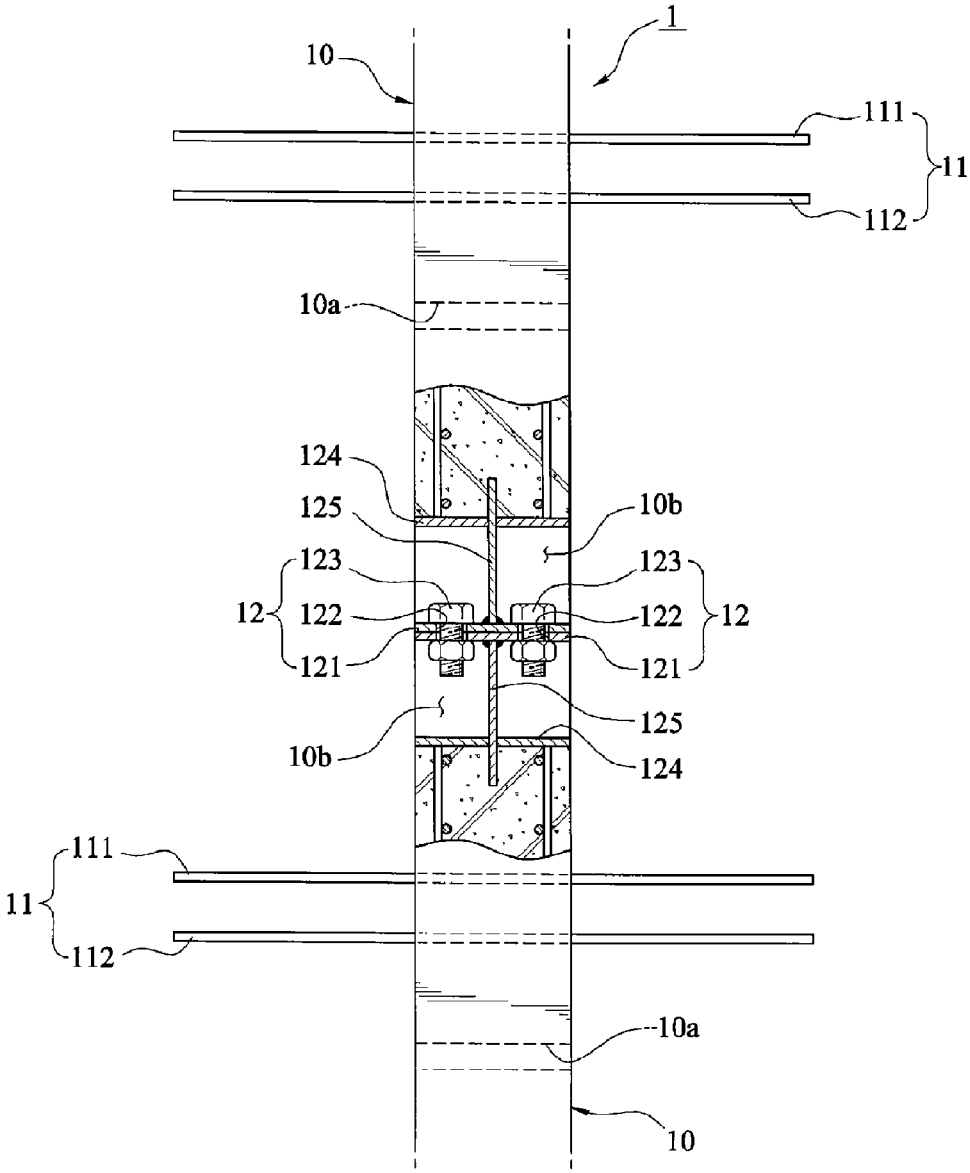

FIGS. 15 and 16 illustrate a modification of the iron wall connection frame. In this modification, the iron wall connection frame 12 comprises a planar iron plate 121, which is integrally provided along the edge surfaces of each PC wall member 10. A plurality of depressions 10*b* is formed in the edge surfaces of the PC wall member 10. Locking holes 122 are formed through the part of the planar iron plate 121 corresponding to each depression 10*b* at respective opposite positions with respect to the lateral direction of the planar iron plate 121, so that locking bolts 123 are tightened into the respective locking holes 122.

In the case of the iron wall connection frame 12 according to the modification, in a state in which the adjacent PC wall members 10 come into contact with each other through the planar iron plates 121, the locking bolts 123 are inserted into the respective locking holes 122, which are disposed in the depressions 10*b* of the PC wall members 10, and are tightened by locking nuts, so that the PC wall members 10 are securely coupled to each other.

Preferably, to reinforce the PC wall member 10, a covering iron plate 124 is provided on the inner surface of each depression 10*b* of the PC wall member 10. Furthermore, each of the parts of the planar iron plate 121, which are disposed at a position corresponding to the corresponding depression 10*b*, is reinforced by a subsidiary iron plate 125, which is provided at a central position in the depression 10*b* to partition the space in the depression 10*b* into two portions.

Figure 17:
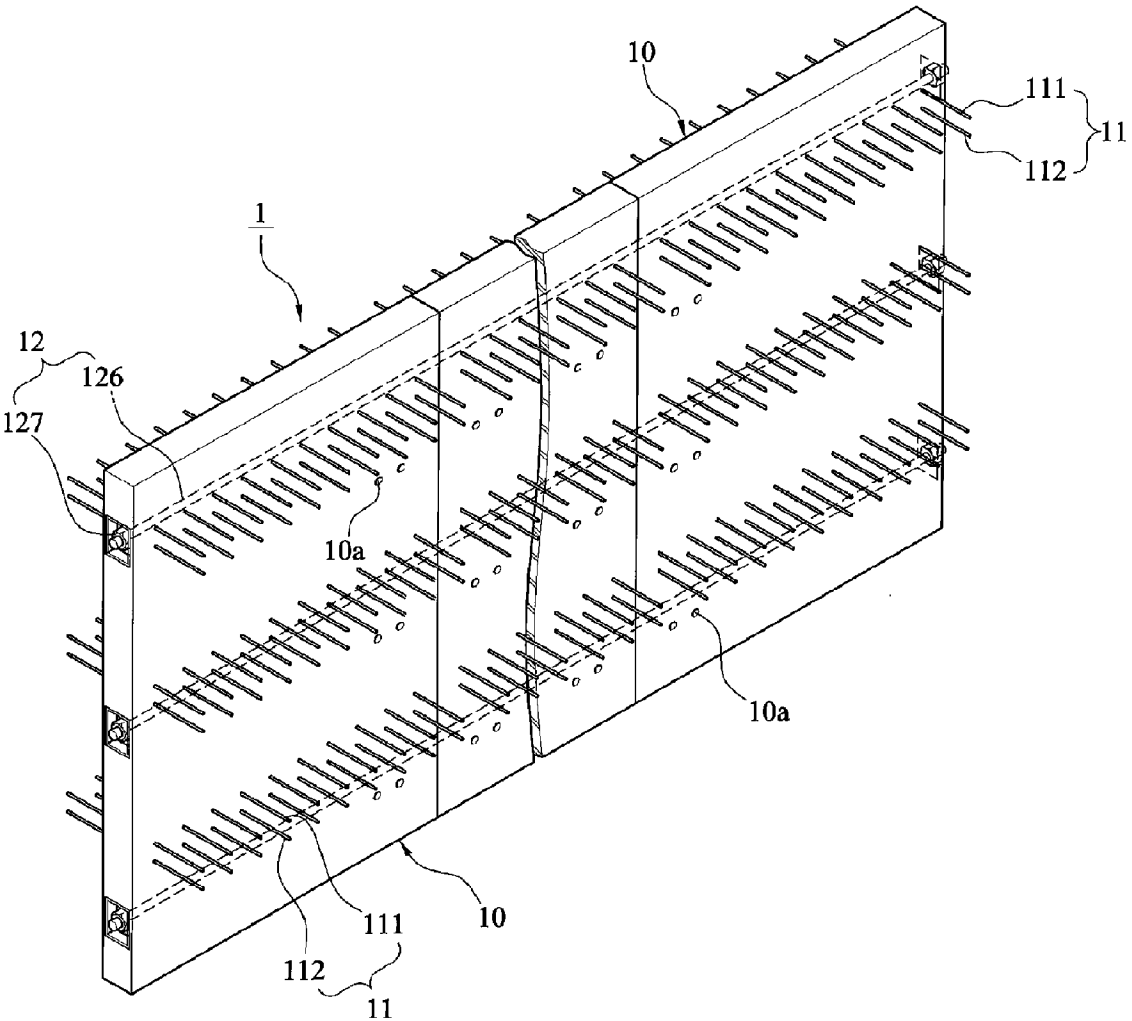
FIGS. 17 and 18 are views showing another modification of the iron wall connection frame provided on the PC wall member according to the embodiment of the present invention.
Figure 18:
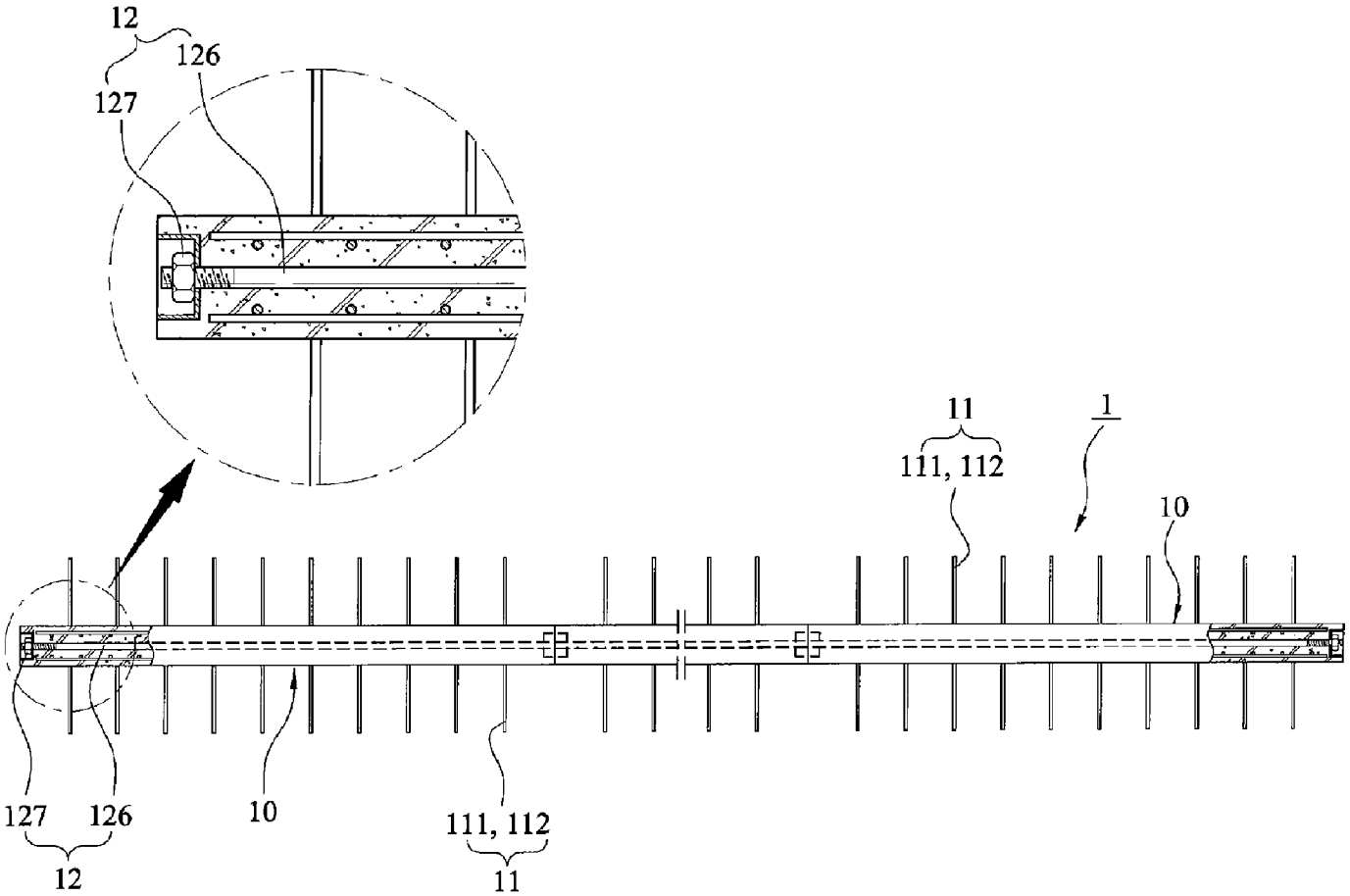

FIGS. 17 and 18 illustrate another modification of the iron wall connection frame. The iron wall connection frame 12 according to this modification comprises a tension steel wire 126, which is inserted through the cross-sections of the PC wall members 10 in a widthwise direction and is tightened at the opposite ends thereof by tightening nuts 127.

That is, in the iron wall connection frame 12 according to this modification, in the state in which the adjacent PC wall members 10 are placed such that facing edge surfaces thereof are brought into contact with each other, the tightening nuts 127 are tightened to the opposite ends of the tension steel wire 126, which is inserted through the PC wall members 10 in a widthwise direction, such that the tension steel wire 126 is tensioned. Thereby, the PC wall members 10 are securely coupled to each other.

The PC slab 2 is supported on the supporting molds 3, which are fastened to the PC wall members 10 just below the connection reinforcing bars 11, which protrude from the PC wall members 10 of the PC wall 1, and is coupled to the PC wall 1 by connection concrete 4, which is cast at a construction site.

FIGS. 19 through 26 illustrate the arrangement of open reinforcing bars. Each PC slab member 20 is a planar plate, which is previously manufactured in a factory. The PC slab member 20 is shorter than the distance between the PC walls 1, and the open reinforcing bars 21 horizontally protrude from the opposite edge surfaces of the PC slab member 20.

The open reinforcing bars 21 of each PC slab member 20 overlap with the connection reinforcing bars 11, which protrude from the corresponding PC wall members 10 of the PC walls 1, and are embedded in connection concrete 4, which is cast at a construction site to couple the PC walls 1 to the PC slab 2, thus forming a slab.

Figure 19:
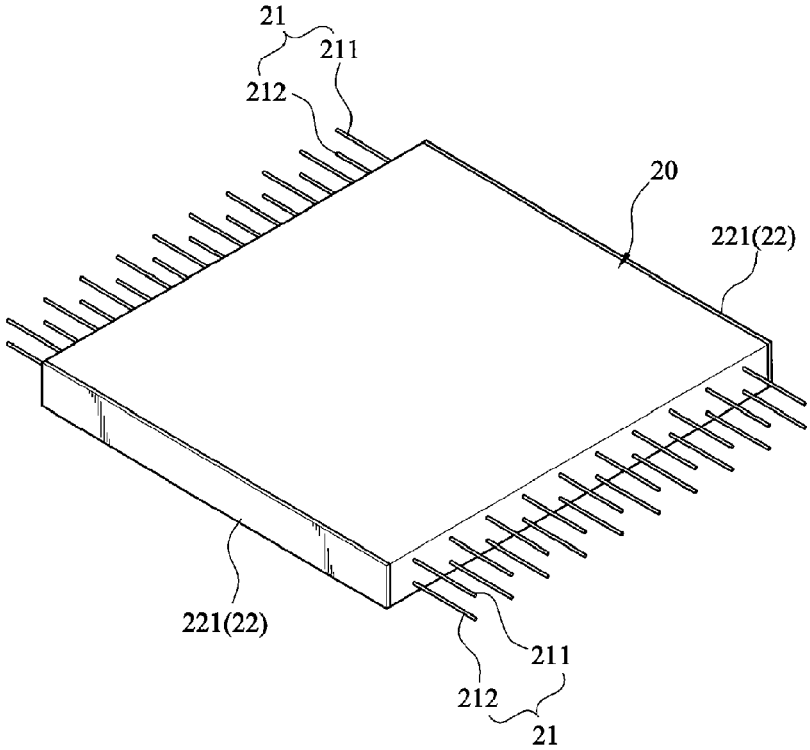
FIGS. 19 and 20 are views showing a PC slab member having open reinforcing bars, according to the embodiment of the present invention.
Figure 20:
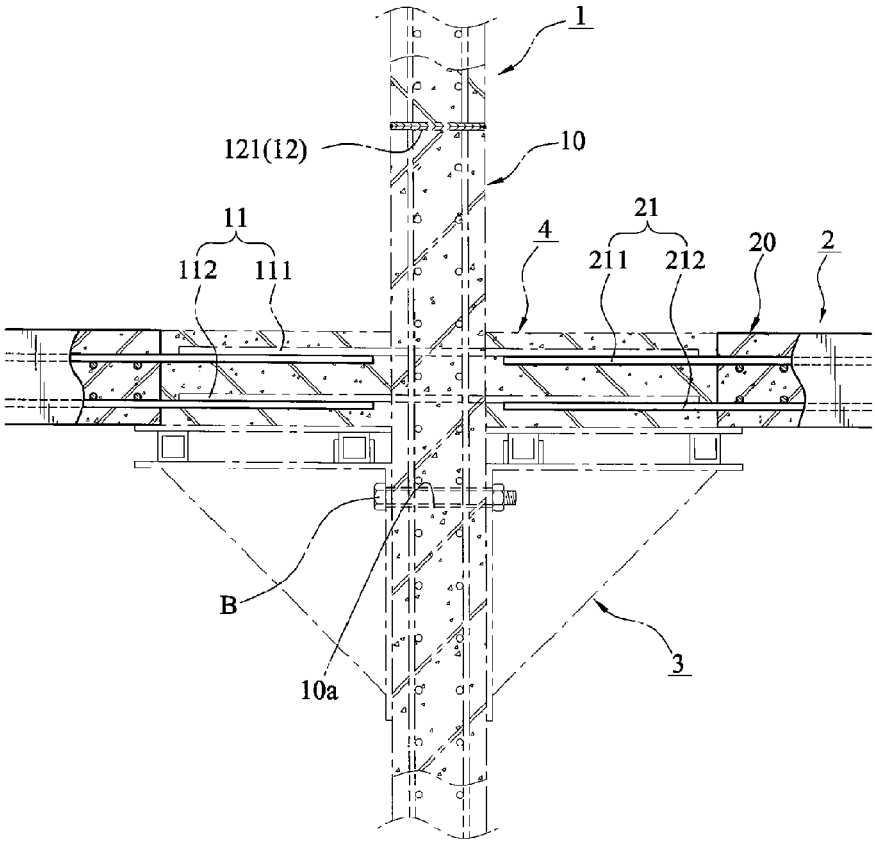

In the embodiment of the present invention, as shown in FIGS. 19 and 20, the open reinforcing bars 21 comprise upper and lower reinforcing bars 211 and 212, which are partially embedded in the cross-section of the PC slab member 20 such that longitudinal opposite ends thereof are exposed from the longitudinal opposite edge surfaces of the PC slab member 20 and are arranged in a widthwise direction. The upper and lower reinforcing bars 211 and 212 overlap with the corresponding connection reinforcing bars 11, which protrude from the PC wall members 10 of the PC walls 1, and are embedded in the connection concrete 4, which is cast at a construction site, to couple the PC walls 1 to the PC slab 2 to each other, thus structurally reinforcing the connection concrete.

Figure 21:
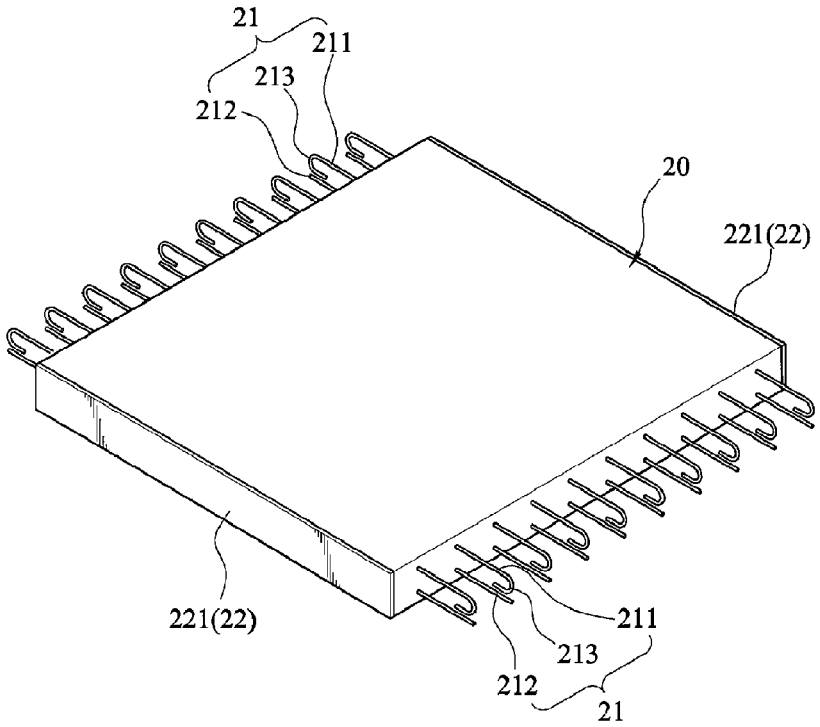
FIGS. 21 and 22 are views showing a modification of the open reinforcing bars of the PC slab member according to the present invention.
Figure 22:
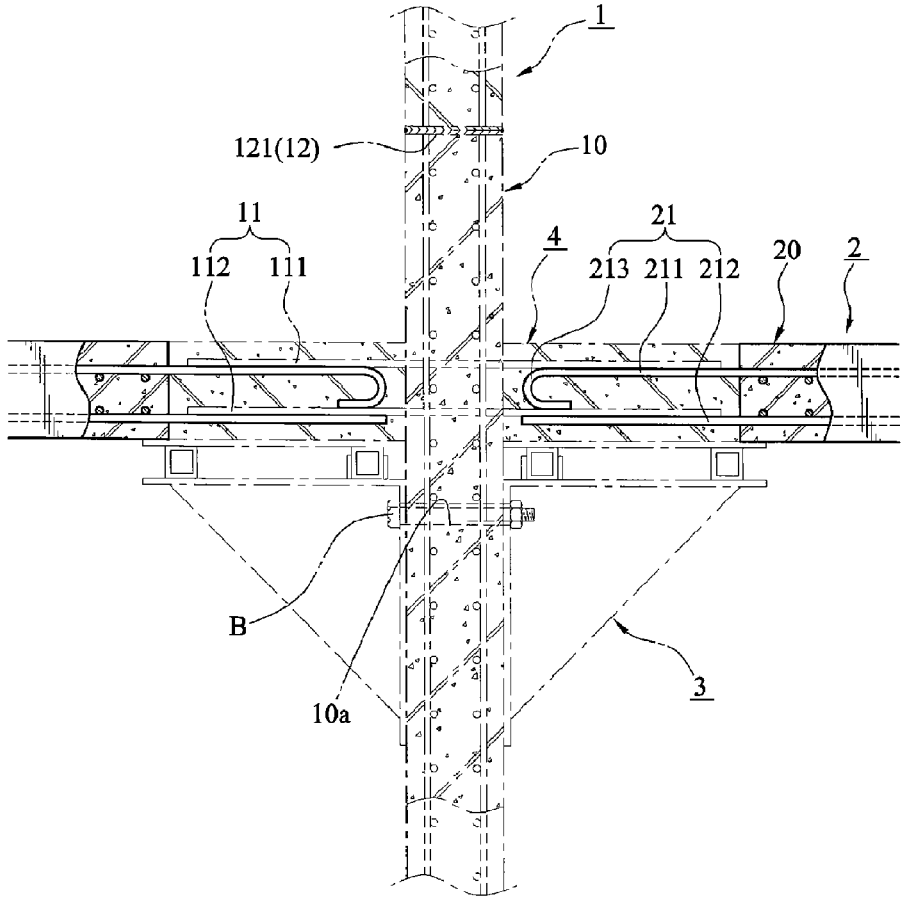
Figure 23:
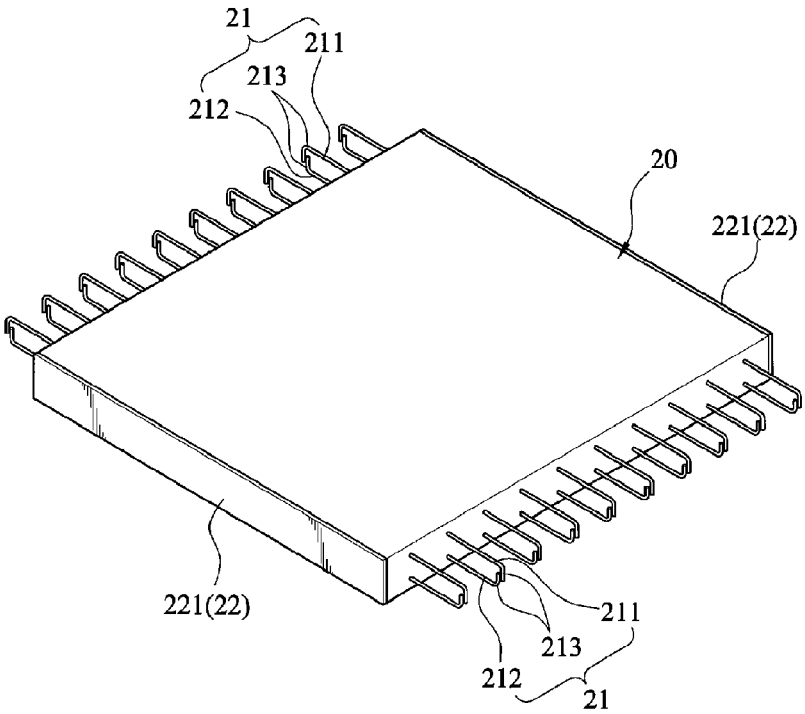
FIGS. 23 and 24 are views showing another modification of the open reinforcing bars of the PC slab member according to the present invention.
Figure 24:
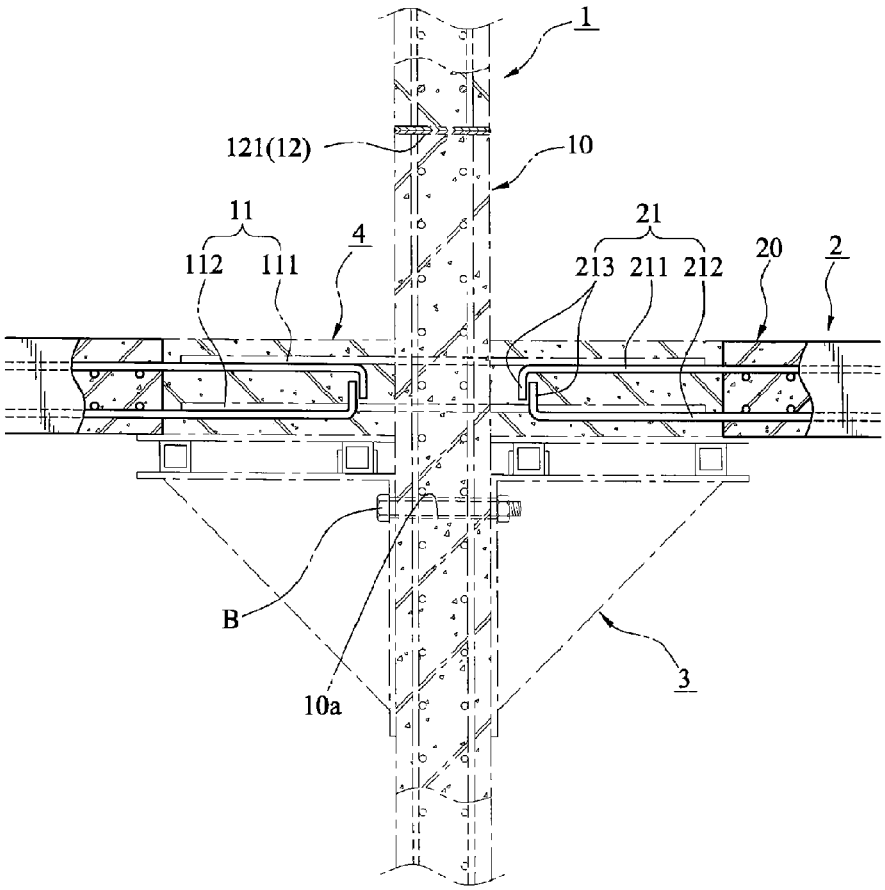

Meanwhile, in a modification of the open reinforcing bars 21, as shown in FIGS. 21 and 22, the open reinforcing bars 21 comprise upper and lower reinforcing bars 211 and 212, which are partially embedded in the cross-section of the PC slab member 20 such that longitudinal opposite ends thereof are exposed from the longitudinal opposite edge surfaces of the PC slab member 20 and are arranged in a widthwise direction, and one kind of upper and lower reinforcing bar 211 and 212 may have on the ends thereof bent parts 213, which are curved into hook shapes. Alternatively, as shown in FIGS. 23 and 24, illustrating another modification, the open reinforcing bars 21 may comprise upper and lower reinforcing bars 211 and 212, which are partially embedded in the cross-section of the PC slab member 20 such that longitudinal opposite ends thereof are exposed from the longitudinal opposite edge surfaces of the PC slab member 20 and are arranged in a widthwise direction, both of the upper and lower reinforcing bars 211 and 212 having on the ends thereof bent parts 213, which are bent at right angles.

As such, in these modifications, the bent parts 213 are formed on the ends of the open reinforcing bars 21, so that the lengths to which the open reinforcing bars 21 protrude from the PC slab member 20 are reduced, thus making it easy to carry and handle. Furthermore, when the PC slab members 20 are moved, deformation of the open reinforcing bars 21 attributable to contact with other objects is minimized, and a worker is prevented from being injured by the ends of the open reinforcing bars 21.

Figure 25:
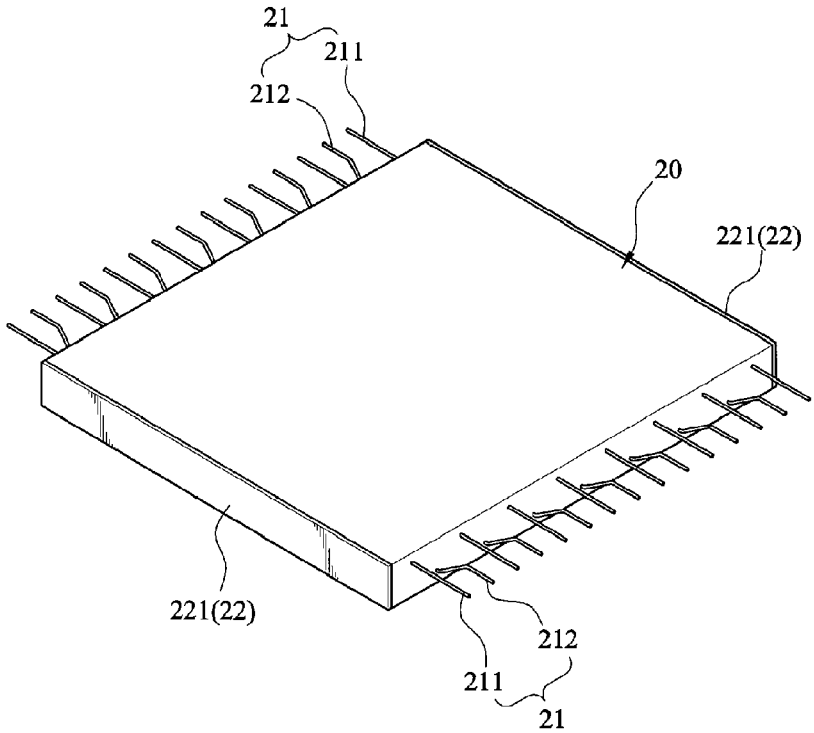
FIGS. 25 and 26 are views showing another modification of the open reinforcing bars of the PC slab member according to the present invention.
Figure 26:
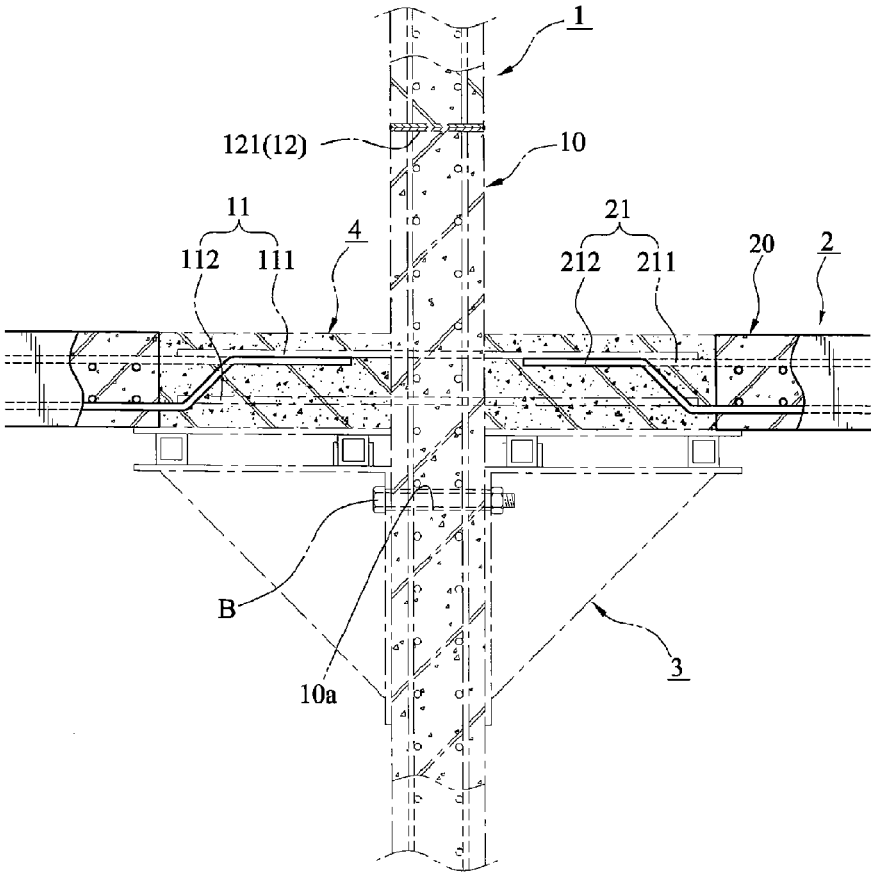

FIGS. 25 and 26 illustrate another modification of the open reinforcing bars 21. In this modification, the open reinforcing bars 21 comprise upper and lower reinforcing bars 211 and 212, which are partially embedded in the PC slab member 20 in horizontal directions such that the longitudinal opposite ends thereof protrude from the PC slab member 20 and are arranged in widthwise directions. The upper reinforcing bars 211 are linearly oriented in horizontal directions, while some of the lower reinforcing bars 212 are bent upwards.

As such, in the open reinforcing bars 21 according to this modification, the upper reinforcing bars 211, which are linearly oriented in horizontal directions, and the lower reinforcing bars 212, which are bent upwards, are overlapped with the corresponding connection-reinforcing bars 11, which protrude from the PC wall members 10 of the PC walls 1, and are embedded in connection concrete 4, which is cast at a construction site to couple the PC walls 1 to the PC slab 2, thus reinforcing the connection concrete 4 such that the connection concrete 4 can resist shear force generated by a vertical load.

Meanwhile, each PC slab member 20 includes an iron slab connection frame 22, so that the adjacent PC slab members 20 can be consecutively connected to each other through the iron slab connection frames 22 by butt-jointing.

Figure 27:
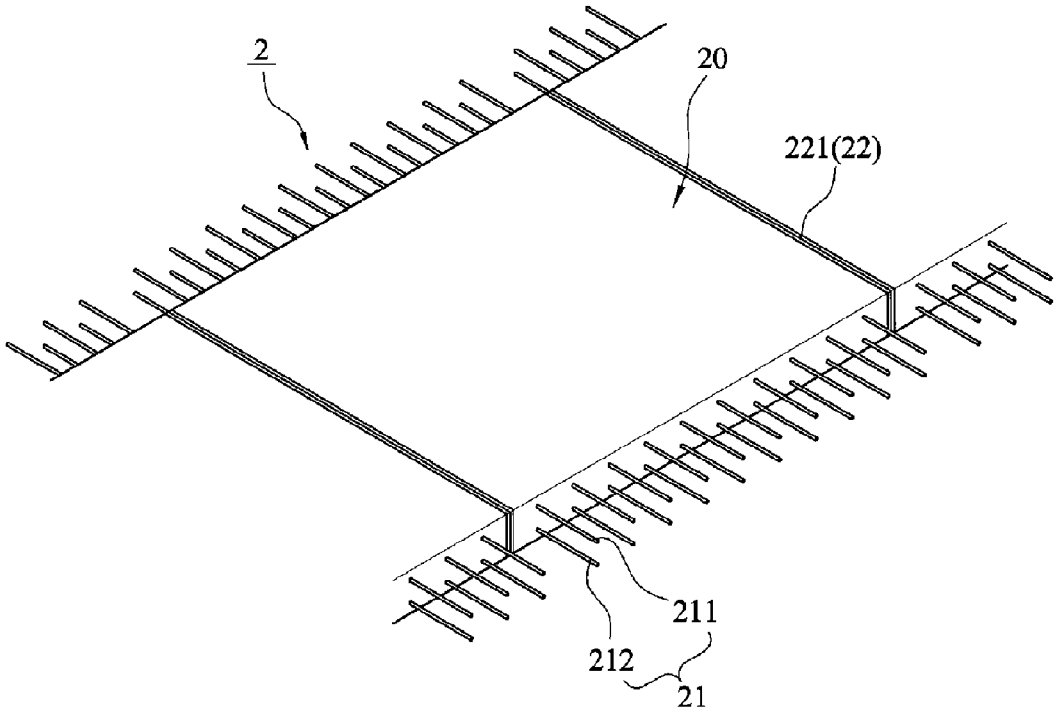
FIGS. 27 and 28 are views showing an iron slab connection frame provided on the PC slab member according to the embodiment of the present invention.
Figure 28:
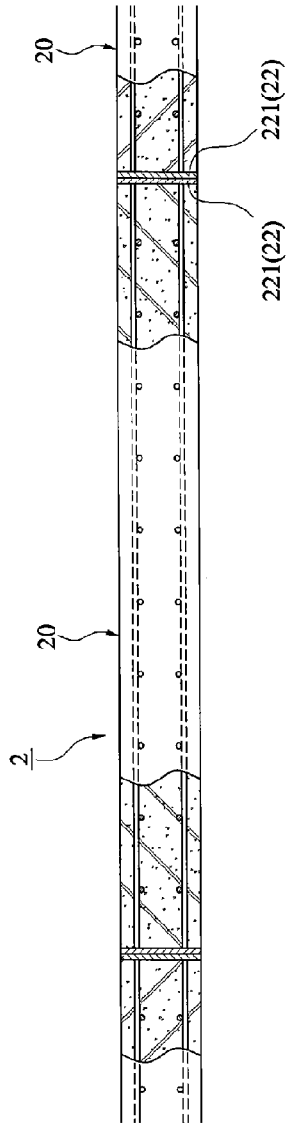

In the embodiment of the present invention, as shown in FIGS. 27 and 28, the iron slab connection frame 22 comprises planar iron plates 221, which are integrally provided on respective edge surfaces of each PC slab member 20 that are opposite each other in the widthwise direction. Thus, the adjacent PC slab members 20 are coupled to each other by butt-joint welding through the iron slab connection frames 22, which comprise the planar iron plates 221.

Figure 29:
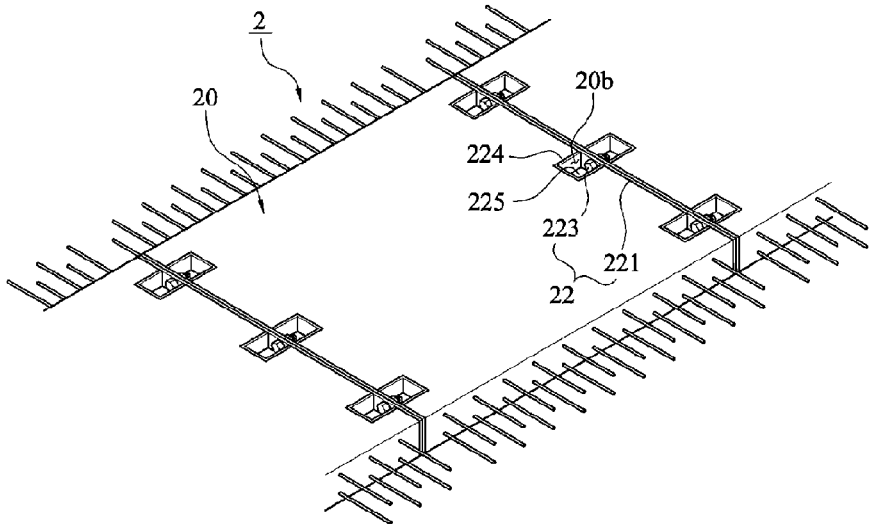
FIGS. 29 and 30 are views showing a modification of the iron slab connection frame provided on the PC slab member according to the embodiment of the present invention.
Figure 30:
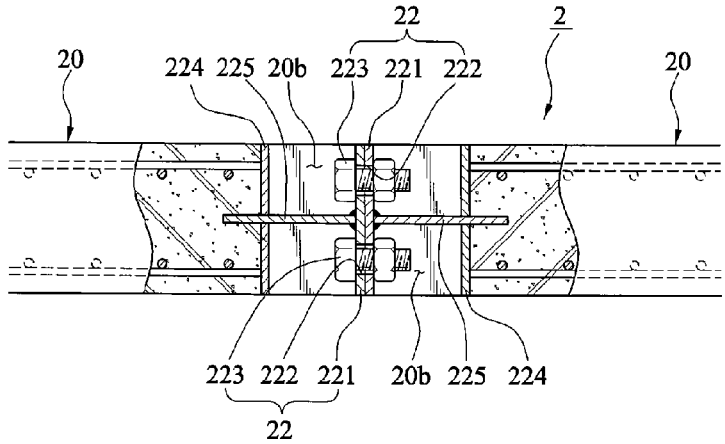

FIGS. 29 and 30 illustrate a modification of the iron slab connection frame. In this modification, the iron slab connection frame 22 comprises planar iron plates 221, which are integrally provided on the edge surfaces of the PC slab member 20 that are opposite each other in the widthwise direction. A plurality of depressions 20*b* is formed in the opposite edge surfaces of the PC slab member 20. Locking holes 222 are formed through the part of the planar iron plate 221 corresponding to each depression 20*b* at upper and lower positions with respect to the lateral direction of the planar iron plate 221, so that locking bolts 223 are tightened into the respective locking holes 222.

In the case of the iron slab connection frame 22 according to the modification, in a state in which the adjacent PC slab members 22 come into contact with each other through the planar iron plates 221, the locking bolts 223 are inserted into the respective locking holes 222, which are disposed in the depressions 20*b* of the PC slab members 20, and are tightened by locking nuts, so that the PC slab members 20 are securely coupled to each other.

Preferably, to reinforce the PC slab member 10, a covering iron plate 224 is provided on the inner surface of each depression 20*b* of the PC slab member 20. Furthermore, each of the parts of the planar iron plate 221, which are disposed at a position corresponding to the corresponding depression 20*b*, is reinforced by a subsidiary iron plate 225, which is provided at a central position in the depression 20*b*, to section the space in the depression 20*b* into two portions.

Figure 31:
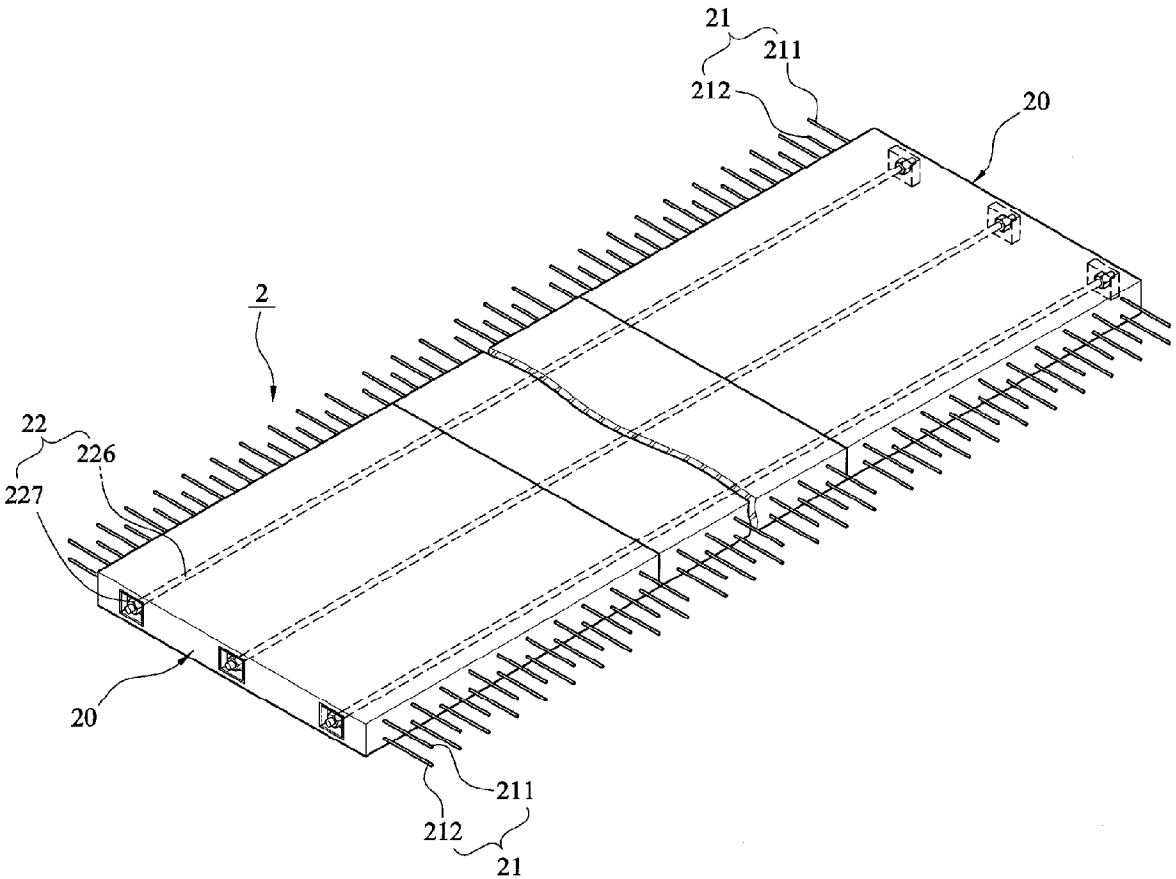
FIGS. 31 and 32 are views showing another modification of the iron slab connection frame provided on the PC slab member according to the embodiment of the present invention.
Figure 32:
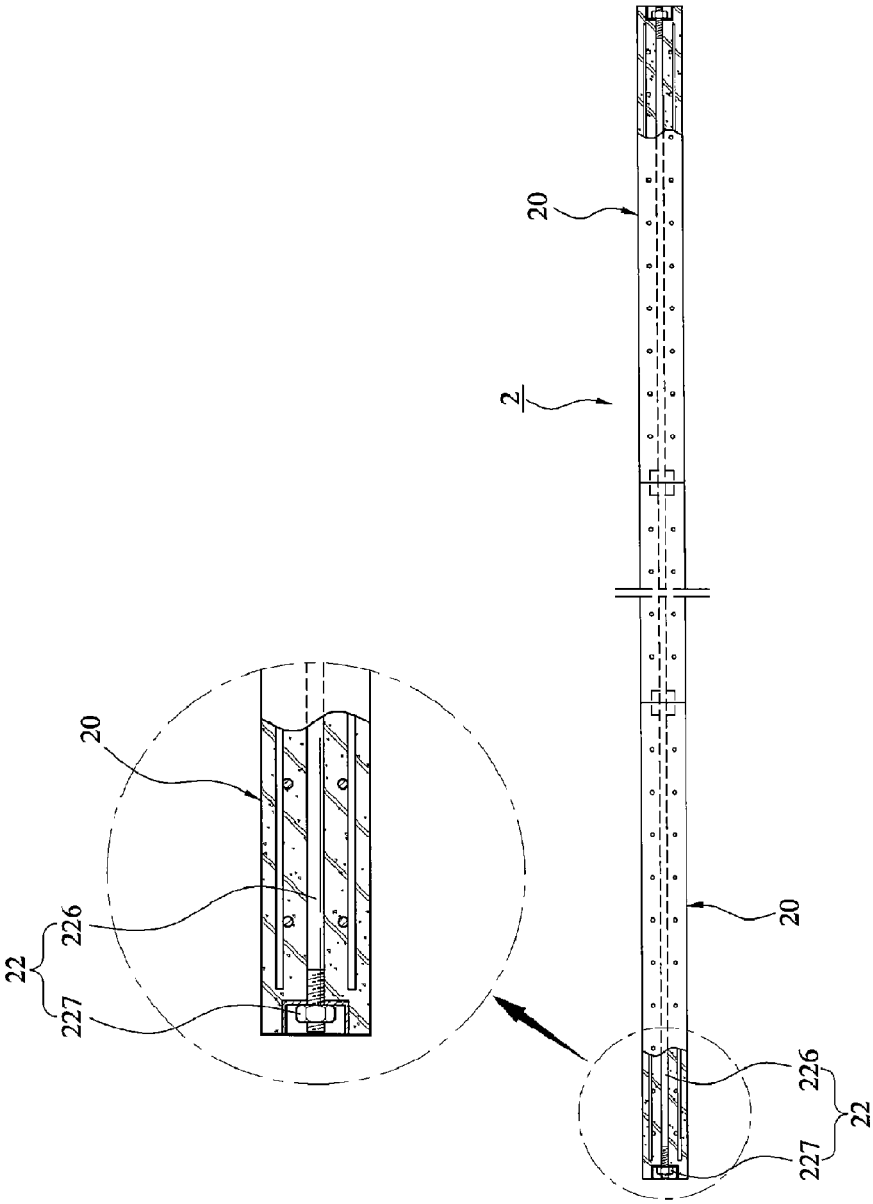

FIGS. 31 and 32 illustrate another modification of the iron slab connection frame. The iron slab connection frame 22 according to this modification comprises a tension steel wire 226, which is inserted through the cross-sections of the PC slab members 20 in a widthwise direction and is tightened at the opposite ends thereof by tightening nuts 227.

That is, in the iron slab connection frame 22 according to this modification, in a state in which the adjacent PC slab members 20 are placed such that facing ends thereof are brought into contact with each other, the tightening nuts 227 are tightened to the opposite ends of the tension steel wire 226, which is inserted through the cross-sections of the PC slab members 20 in a widthwise direction such that the tension steel wire 226 is tensioned, so that the PC slab members 20 are thus securely coupled to each other.

Figure 33:
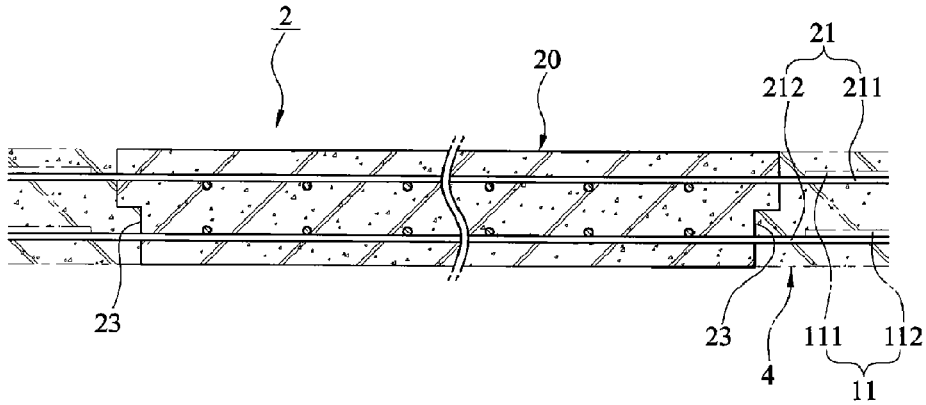
FIG. 33 is a sectional view of a PC slab member having stepped parts on longitudinal opposite ends thereof, according to the present invention.

In the embodiment, although the PC slab members 20 have been illustrated as having planar opposite edge surfaces so that they can be integrated with the connection concrete 4, which is cast at a construction site, in a coupling manner in which the planar edge surfaces of the PC slab members 20 and the connection concrete 4 are in contact with each other, the PC slab members 20 may be integrated with the connection concrete 4 in the coupling manners shown in the following modifications. That is, as shown in FIG. 33, illustrating a modification of the coupling manner, the PC slab member 20 may have on the opposite ends thereof stepped parts 23, in each of which the upper part thereof protrudes outwards and the lower part thereof is depressed, so that the PC slab member 20 is integrated with the connection concrete 4, which is cast at a construction site, in a stepped type coupling manner.

Figure 34:
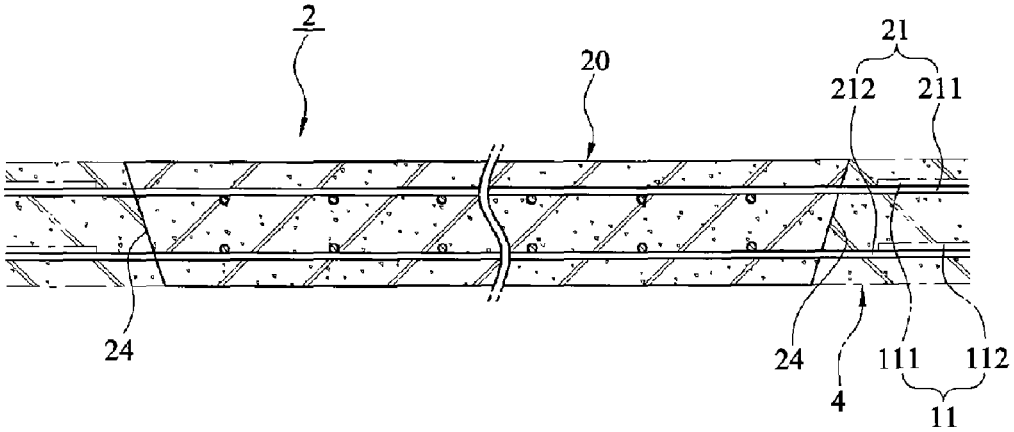
FIG. 34 is a sectional view of a PC slab member having inclined parts on longitudinal opposite ends thereof, according to the present invention.

Alternatively, as shown in FIG. 34, illustrating another modification of the coupling manner, the PC slab member 20 may have on the opposite ends thereof inclined parts 24, each of which is inclined downwards, so that the PC slab member 20 is integrated with the connection concrete 4, which is cast at a construction site, in a wedge type coupling manner.

Figure 35:
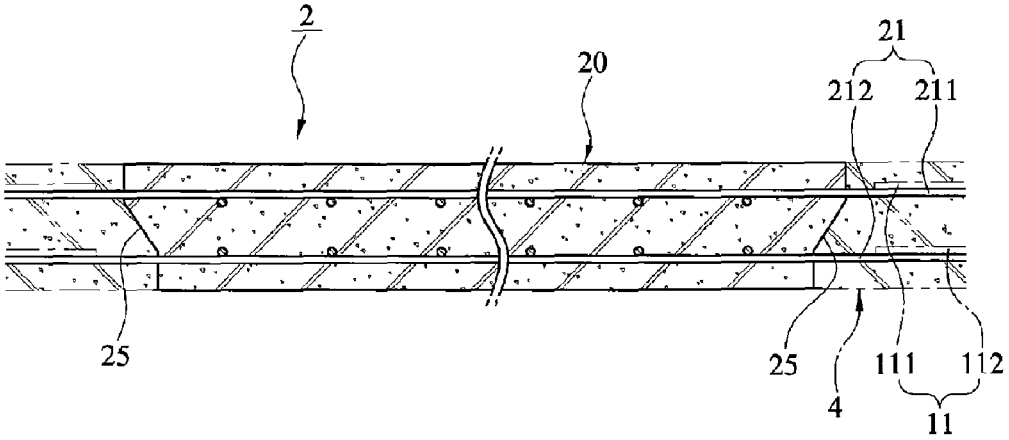
FIG. 35 is a sectional view of a PC slab member having staggered end parts on longitudinal opposite ends thereof, according to the present invention.

As a further alternative, as shown in FIG. 35, illustrating another modification of the coupling manner, the PC slab member 20 may have on the opposite ends thereof staggered end parts 25, in each of which the upper part thereof protrudes outwards, the middle part thereof is inclined downwards, and the lower part thereof is depressed, so that the PC slab member 20 is integrated with the connection concrete 4, which is cast at a construction site, in a staggered end type coupling manner.

Meanwhile, the supporting mold 3 is mounted to each PC wall member 10 of the PC wall 1 just below the connection reinforcing bars 11 of the PC wall member 10. The supporting mold 3 serves to support the PC slab members 20 and makes it possible to cast connection concrete 4 at a construction site.

Figure 36:
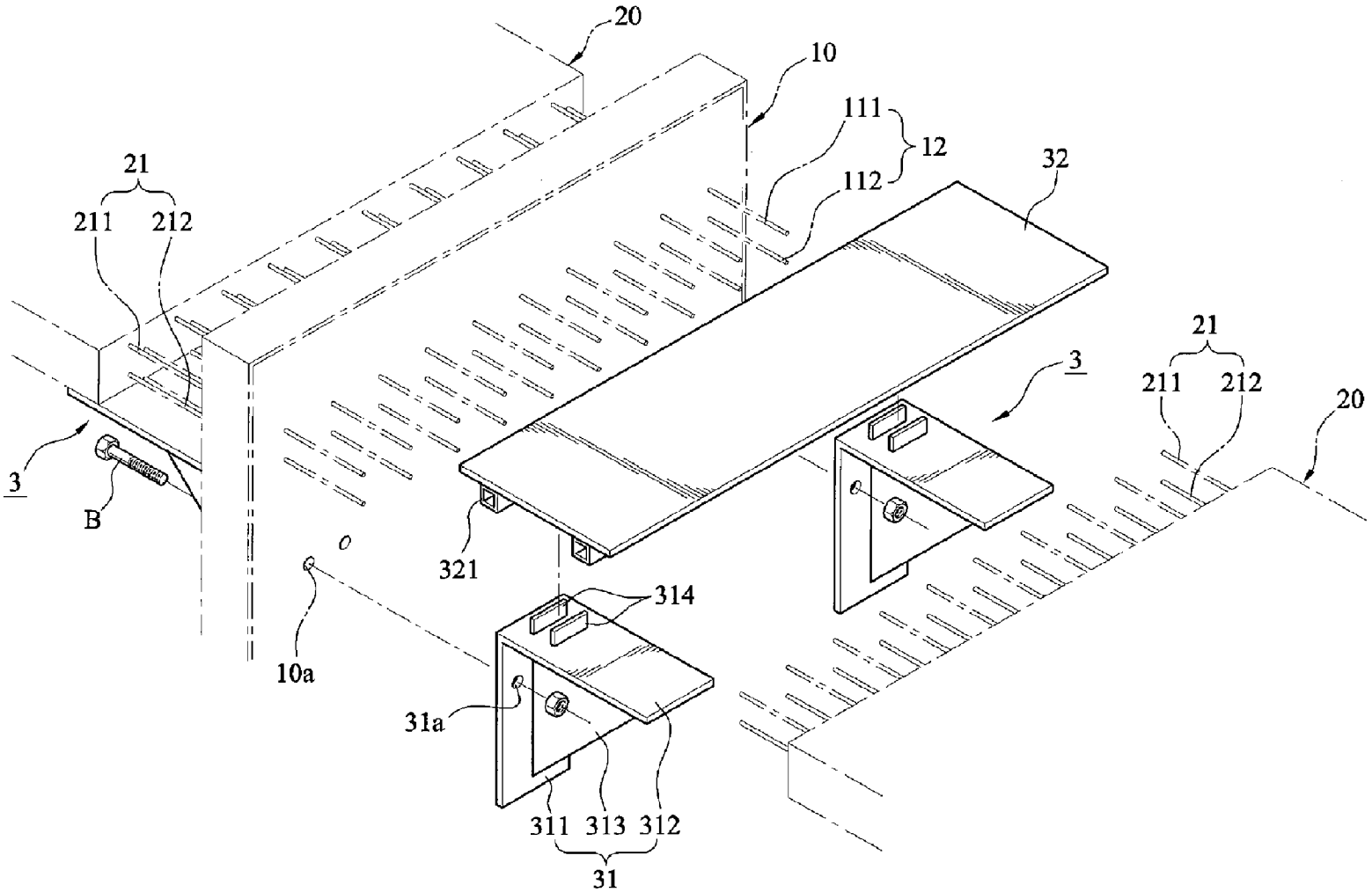
FIG. 36 is an exploded perspective view of a mold having a function as a support, according to the present invention.

In the embodiment of the present invention, as shown in FIG. 36, the supporting mold 3 includes a plurality of support members 31, each of which has a mounting plate 311, which is in contact with the PC wall member 10 and has through holes 31*a* therein. Each support member 31 further has a support plate 312, which perpendicularly extends from the mounting plate 311 and is supported by an inclined propping plate 313. The supporting mold 3 further includes a mold panel 32, which is seated on the support plates 312 of the support members 31. The mold panel 32 has a plate shape, which is relatively narrow and long, and longitudinal rods 321 are provided under the lower surface of the mold panel 32 on opposite sides of the longitudinal axis of the mold panel 32.

To assemble the supporting molds 3 with the PC wall member 10, the mounting plates 311 of the support members 31 are placed on respective opposite surfaces of the PC wall member 10 such that the through holes 31*a* in the mounting plates 311 are aligned with the corresponding bolt holes 10*a* of the PC wall member 10. Thereafter, bolts B are inserted through the corresponding bolt holes 10*a* and through holes 31*a* and are tightened by respective nuts, thus fastening the support members 31 to the PC wall member 10. Subsequently, the mold panels 32 are seated onto the support plates 312 of the corresponding support members 31 using the longitudinal rods 321 of the mold panels 32. As such, after the supporting molds 3 have been assembled with the PC wall member 10, the PC slab members are placed on the corresponding mold panels 32 such that the connection reinforcing bars 11 of the PC wall member 10 are overlapped with the open reinforcing bars 21 of the PC slab members 20. Furthermore, connection concrete 4 is cast on the mold panels 32, so that the connection reinforcing bars 11 of the PC wall member 10 and the open reinforcing bars 21 of the PC slab members 20 are embedded in the connection concrete 4.

Here, after the connection concrete 4 has been completely cured, so that the PC wall 1 and the PC slabs 2 are completely integrated with each other, the bolts B, which were used to mount the mounting plates 311 to the PC wall 1, are loosened to remove the support members 31 and the mold panels 32 from the PC wall 1 and the connection concrete 4, thus removing the supporting molds 3.

Preferably, each support member 31 of the supporting mold 3 has a pair of holding pieces 314 on the support plate 312 thereof, so that one of the longitudinal rods 321 of the mold panel 32 is inserted into and held by the holding pieces 314 of the corresponding support members 31, thus preventing the mold panel 32 from being undesirably moved or removed from the support members 31.

As shown in FIGS. 1 and 2, in a state in which the connection reinforcing bars 11 of the PC wall member 10 of the PC wall 1 are overlapped with the corresponding open reinforcing bars 21 of the PC slab members 20 of the PC slab 2 in a slab area, connection concrete 4 is cast at a construction site on the mold panels 32 of the supporting molds 3, which are mounted just below the connection reinforcing bars 11 of the PC wall member 10 of the PC wall 1, thus integrating the PC wall 1 and the PC slabs 2 with each other in the slab area.

The connection concrete 4 is cast at a construction site by mixing aggregate, water and cement at an appropriate ratio. It is satisfactory if the connection concrete 4 can ensure sufficient structural strength to securely integrate the PC slab 2 to the PC wall after it is completely cured.

Hereinafter, a method of constructing a structure using the PC members according to the embodiment of the present invention will be explained in detail with reference to the attached drawings.

The method of constructing the structure using the PC members according to the present invention includes the step of constructing PC walls 1 using PC wall members 10, the step of mounting supporting molds 3 to the PC walls 1, the step of placing PC slab members 20 on the supporting molds 3 to construct PC slabs 2, and the step of casting connection concrete 4 such that the PC walls 1 and the PC slabs 2 are integrated with each other in slab areas.

Figure 37:
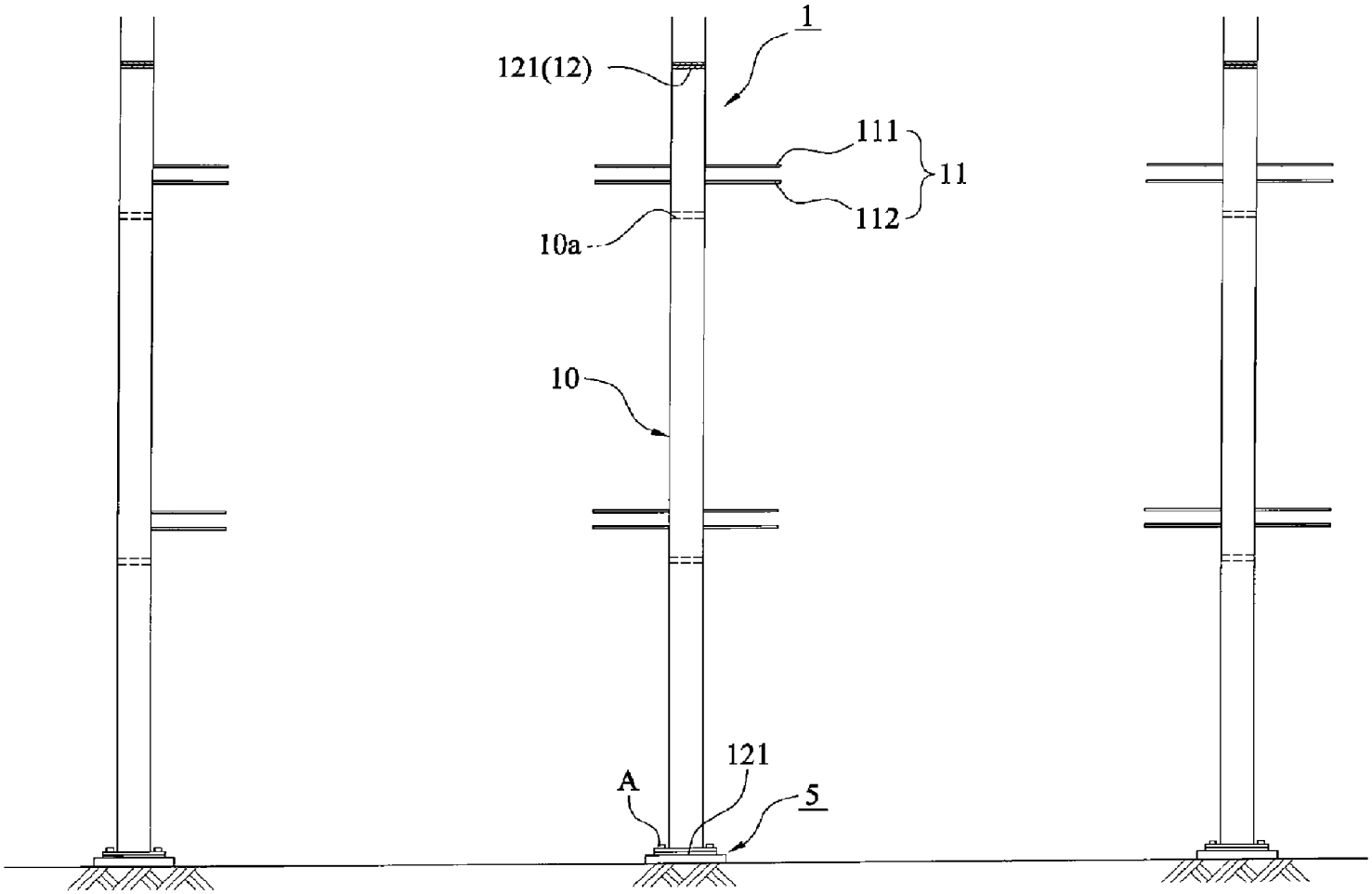
FIGS. 37 through 41 are views illustrating a method of constructing a structure using the PC members according to the present invention.

FIG. 37 illustrates the step of constructing the PC walls at preset positions.

Each PC wall 1 is constructed by consecutively placing upright the PC wall members 10, which are manufactured using concrete in a factory and have the connection reinforcing bars 11 horizontally protruding from the PC wall members 10 at positions at which the PC slab members 20 of the PC slabs 2 are coupled to the PC wall members 10, on the corresponding base 5, which is previously installed at a preset position.

Here, of the PC walls 1, the PC walls 1 which are used as inside walls are constructed by consecutively placing upright the PC wall members 10, which have the connection reinforcing bars 11, which comprise the upper and lower connection reinforcing bars 111 and 112, which horizontally protrude in opposite directions. Thereafter, the PC slabs 2 are coupled to the opposite surfaces of the PC walls 1, which become the inside walls. Of the PC walls 1, the PC walls 1 which are used as outside walls are constructed by consecutively placing upright the PC wall members 10, which have the connection reinforcing bars 11, which comprise the upper and lower connection reinforcing bars 111 and 112, which horizontally protrude in one direction. The PC slabs 2 are coupled to the inner surfaces of the PC walls 1, which become the outside walls.

Furthermore, the bolt holes 10*a* are formed just below the connection reinforcing bars 11, which horizontally protrude from the PC wall members 10, which are consecutively placed upright to form the PC walls 1, so that the supporting molds 3 can be mounted to the PC wall members 10 by bolting.

In the embodiment of the present invention, the adjacent PC wall members 10 of each PC wall 1 have been illustrated as being integrally coupled to each other by butt-joint welding the iron wall connection frames 12, which comprise the planar iron plates 121, which are integrally provided along the edge surfaces of the PC wall members 10, to each other.

Furthermore, the lowermost PC wall members 10 of each PC wall 1 have on the lower edge surfaces thereof the planar iron plates 121, which are relatively wide, and the wide planar iron plates 121 are placed on and are fastened to the corresponding base 5 by tightening anchor bolts A into the base 5 through the wide planar iron plates 121. Thus, the lowermost PC wall members 10 can be securely fastened to the base 5.

Figure 38:
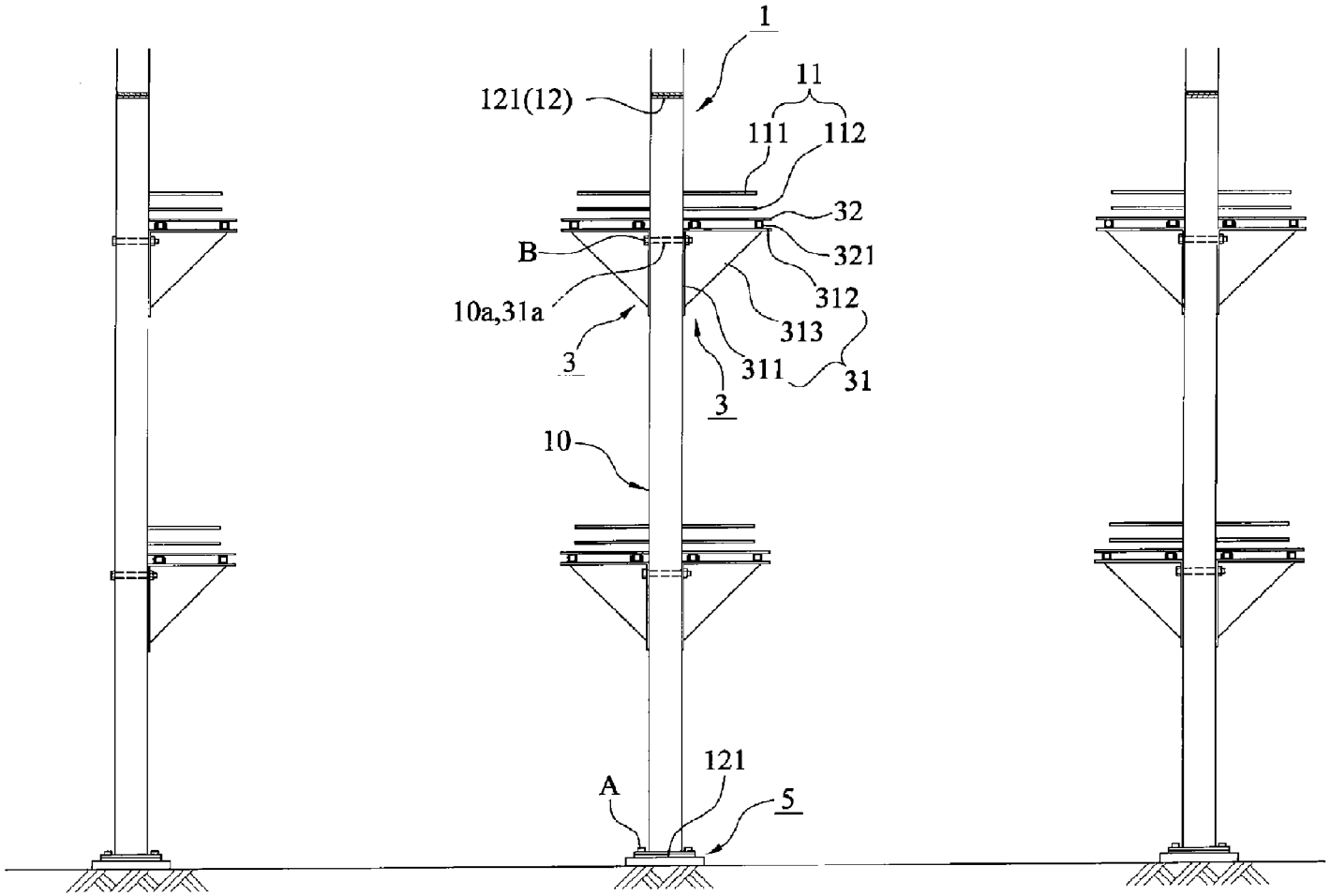

FIG. 38 illustrates the step of removably mounting the support-function molds 3 to the PC wall members 10 of the PC walls 1 at positions just below the connection reinforcing bars 11, which protrude from the PC wall members 10.

In the embodiment of the present invention, the supporting molds 3 are manufactured and prepared in advance such that each includes the support members 31, each of which has a mounting plate 311, which is in contact with the corresponding PC wall member 10 and has the through holes 31*a* therein, the support member 31 further having the support plate 312, which perpendicularly extends from the mounting plate 311 and is supported by the inclined propping plate 313, the supporting mold 3 further including the mold panel 32, which is seated onto the support plates 312 of the support members 31 and has a plate shape, which is relatively narrow and long and is provided with longitudinal rods 321 under the lower surface thereof on opposite sides of the longitudinal axis thereof. The mounting plates 311 of the prepared supporting molds 3 are disposed on opposite surfaces of the corresponding PC wall member 10 of the PC wall 1 such that the mounting plates 311 are aligned with each other and the through holes 31*a* of the mounting plates 311 are aligned with the corresponding bolt holes 10*a* of the PC wall member 10. Thereafter, bolts B are inserted through the corresponding bolt holes 10*a* and through holes 31*a* and are tightened by respective nuts, thus fastening the support members 31 to the PC wall member 10. Subsequently, the mold panels 32 are seated onto the support plates 312 of the corresponding support members 31 such that the longitudinal rods 321 of the mold panels 32 are held by the holding pieces 314 of the support plate 312.

As such, the supporting molds 3, which are mounted to the PC wall member 10, serve to make it possible to place the PC slab members 20 on the corresponding mold panels 32 such that the connection reinforcing bars 11 of the PC wall member 10 are overlapped with the open reinforcing bars 21 of the PC slab members 20, and to cast connection concrete 4 on the mold panels 32 such that the connection reinforcing bars 11 of the PC wall member 10 and the open reinforcing bars 21 of the PC slab members 20 are embedded in the connection concrete 4.

Thereafter, the connection concrete 4 is cured until the PC wall 1 and the PC slabs 2 are completely integrated with each other. After the connection concrete 4 has been completely cured, the bolts B, which have mounted the mounting plates 311 to the PC wall 1, are loosened to remove the support members 31 and the mold panels 32 from the PC wall 1 and the connection concrete 4. Ultimately, the supporting molds 3 are removed from the PC wall 1.

Figure 39:
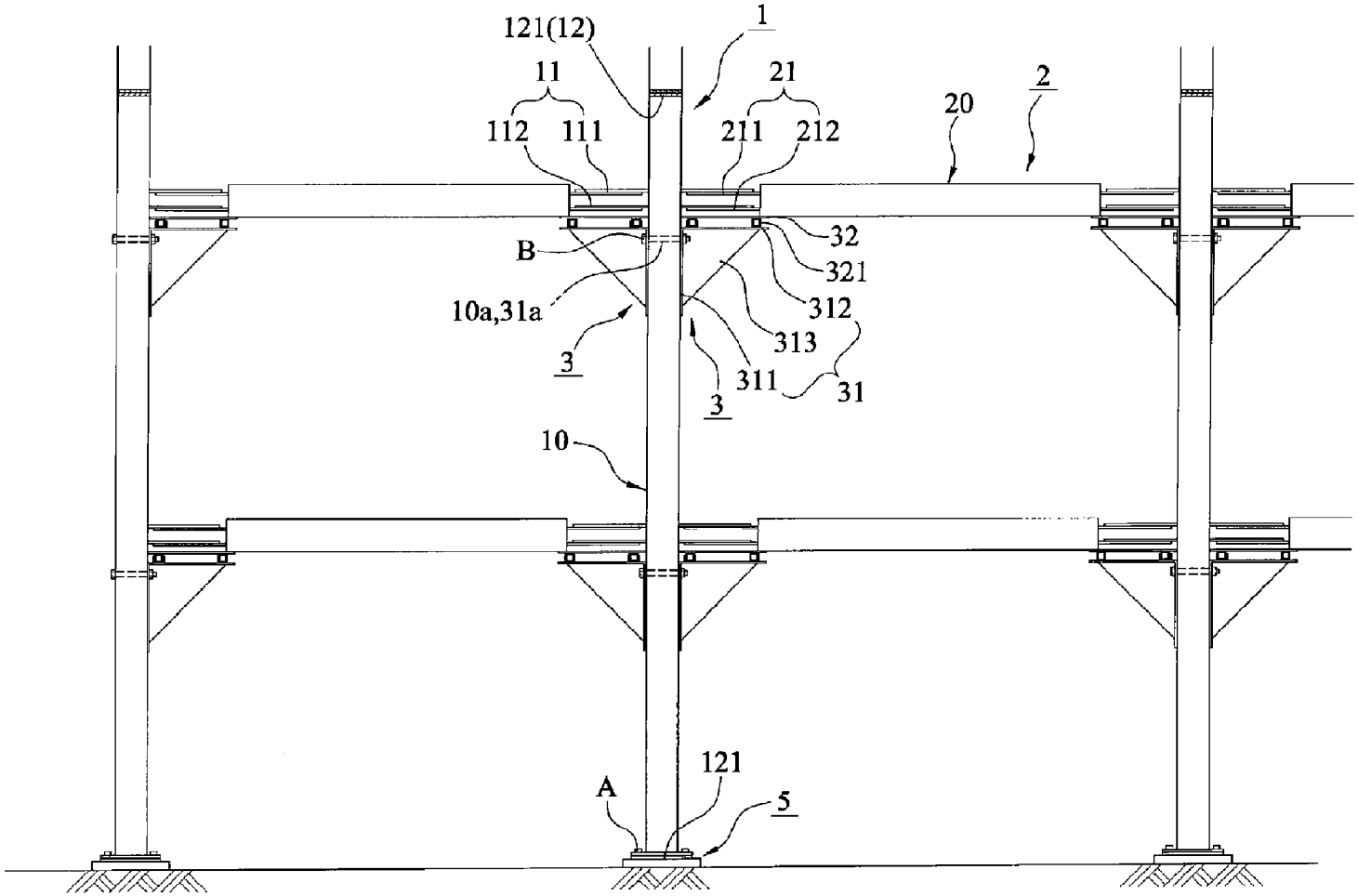

FIG. 39 illustrates the step of placing the PC slab members 20 on the supporting molds 3 to install the PC slabs 2.

To install the PC slabs 2, the PC slab members 20, each of which has the open reinforcing bars 21, which comprise the upper and lower reinforcing bars 211 and 212, which are shorter than the distance between the adjacent PC walls 1 and protrude from the opposite edge surfaces of the PC slab members 20, are placed on the corresponding supporting molds 3, such that the open reinforcing bars 21 of the PC slab members 20 are overlapped with the corresponding connection reinforcing bars 11 of the PC wall members 10 in the slab areas.

In the embodiment of the present invention, to construct each PC slab 2, the adjacent PC slab members 20 have been illustrated as being integrally coupled to each other by butt-joint welding the iron slab connection frames 22, which comprise the planar iron plates 221, which are integrally provided on the opposite edge surfaces of the PC slab members 20, to each other.

Figure 40:
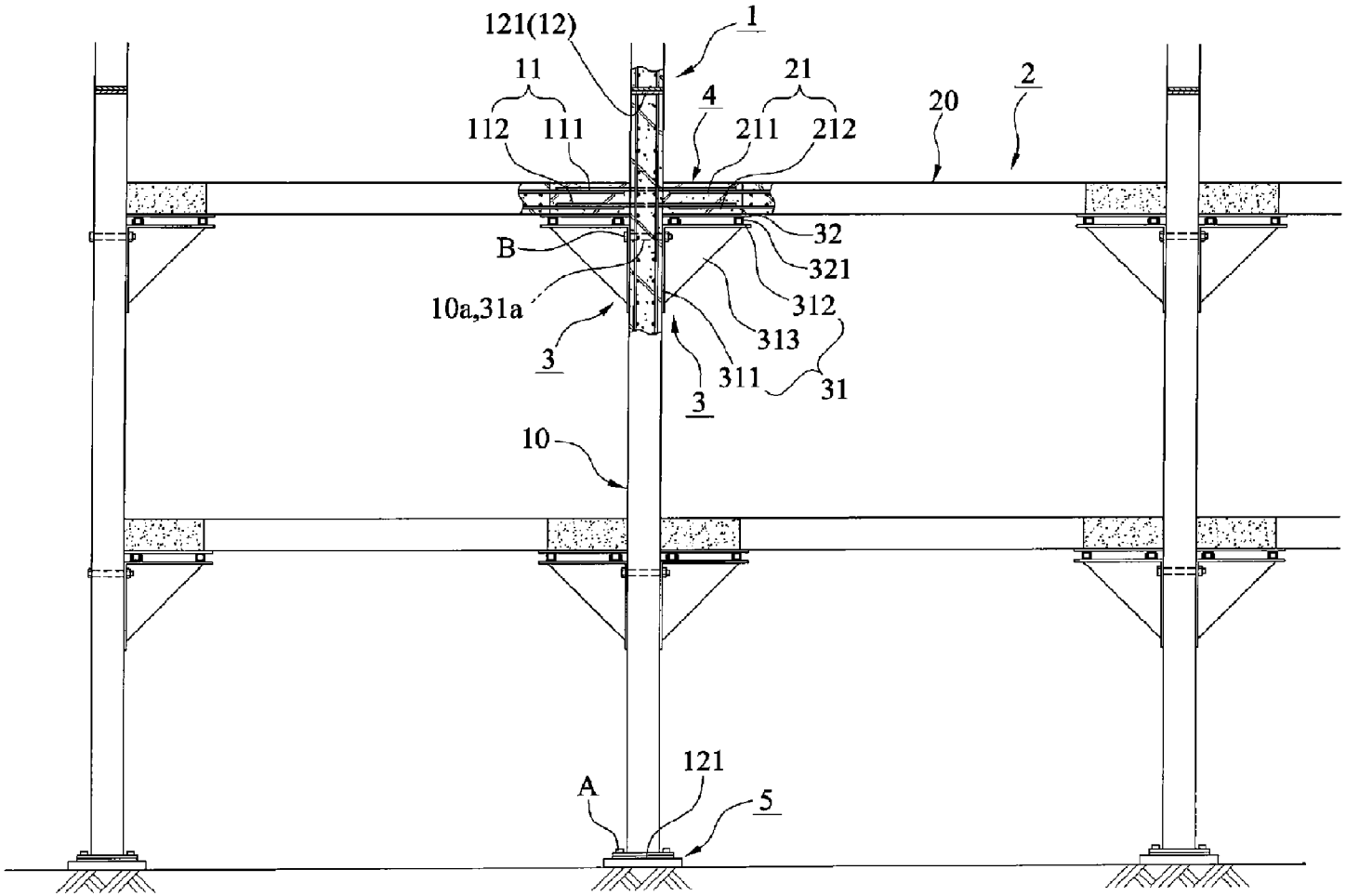

FIG. 40 illustrates the step of casting connection concrete 4 at a construction site to integrate the PC slabs 2 to the corresponding PC walls 1.

In the state in which the open reinforcing bars 21 of the PC slab members 20 are overlapped with the corresponding connection reinforcing bars 11 of the PC wall members 10 in the slab areas, connection concrete 4 is cast on the mold panels 32 of the supporting molds 3 at the construction site and is cured, thus integrating the PC slabs 2 to the PC walls 1 in the slab areas.

Figure 41:
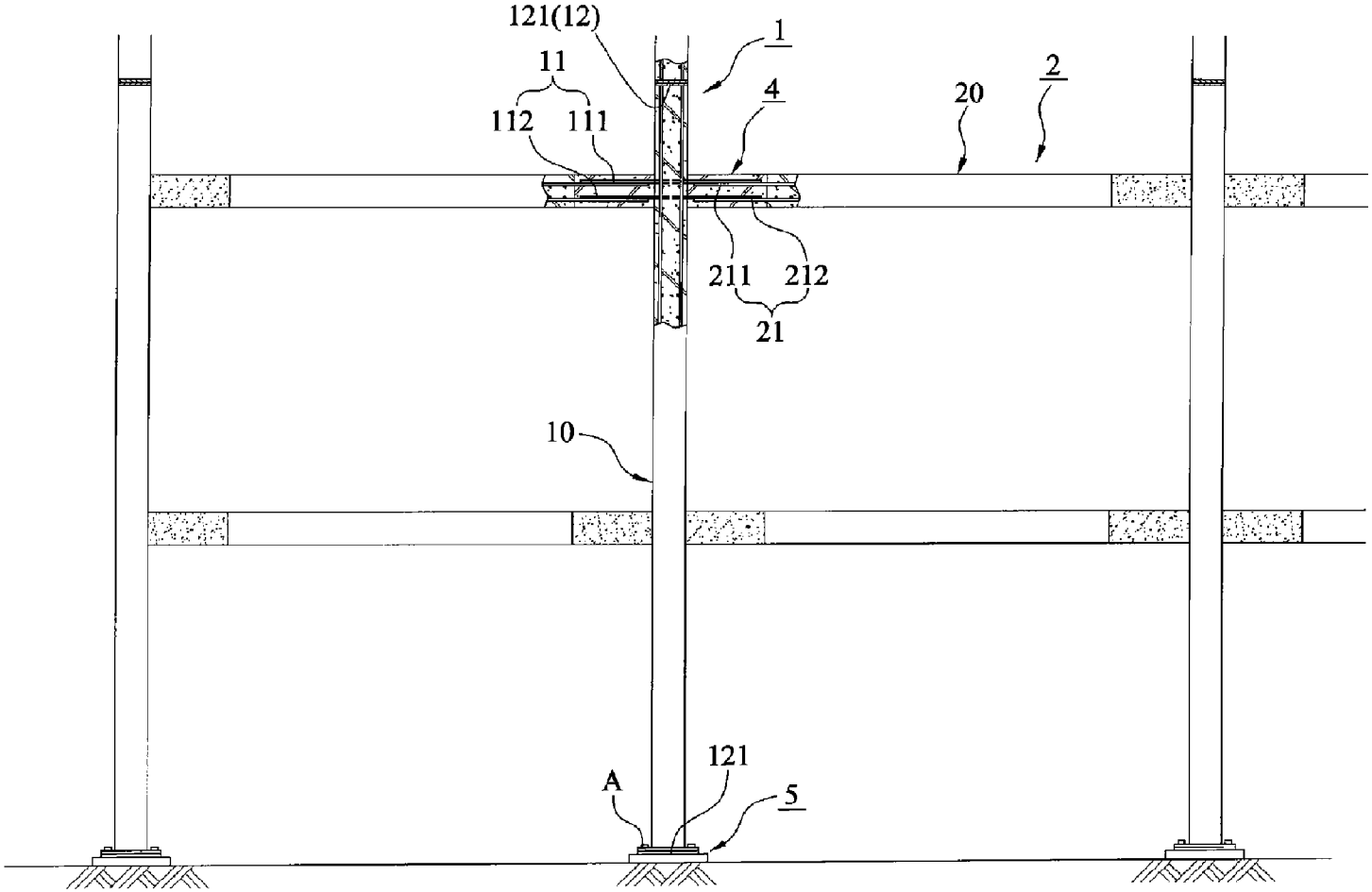

After the connection concrete 4, which is cast at the construction site, is completely cured and the PC slabs 2 are thus completely integrated with the PC walls 1, the supporting molds 3 are removed from the PC walls 1 and the connection concrete 4, thus completing the structure shown in FIG. 41.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

As described above, in the present invention, connection reinforcing bars of PC wall members and open reinforcing bars of PC slab members are overlapped and integrated with each other in slab areas by connection concrete, which is cast at a construction site. Therefore, the range of a junction between each PC wall and the corresponding PC slab is dispersed over the area of the corresponding slabs. Thus, working conditions for conducting the operation of coupling the PC slabs to the PC walls are improved, and construction efficiency is improved.

Furthermore, connection concrete can be fully and closely charged into the reinforcing bar junction, so that an opening is prevented from being formed in the cross-section of the reinforcing bar junction. Therefore, the structural strength of the junctions between the PC walls and the PC slabs can be enhanced.

In addition, the PC slabs are coupled to the PC walls by a construction method in which connection concrete is cast at a construction site using supporting molds. Hence, the PC slab members of the PC slabs can be coupled to the PC wall members of the PC walls at the same time, so that the construction time can be markedly reduced, and, as well, a process of installing wooden concrete forms is not required when the PC slabs are coupled to the PC walls, thus reducing the number of workers and construction costs.

The invention claimed is:

1. A structure constructed using PC members, the structure being constructed by forming PC walls using PC wall members, which are placed upright at predetermined positions, and by forming PC slabs for partitioning floors using PC slab members, which are horizontally provided between the PC wall members of the PC walls, wherein the PC wall members of the PC walls comprise a plurality of connection reinforcing bars, which horizontally protrude from the PC wall members at positions at which slabs, forming multiple stories, are constructed, each of the PC slab members of the PC slabs is shorter than a distance between the PC walls and comprises open reinforcing bars, which protrude from edge surfaces of the PC slab member that are opposite each other in a longitudinal direction, and supporting molds are mounted to the PC wall members at respective positions just below the connection reinforcing bars, which protrude from the PC wall members, so that the PC slab members of the PC slabs are placed on the corresponding supporting molds such that the connection reinforcing bars of the PC wall members of the PC walls are overlapped with the corresponding open reinforcing bars of the PC slab members of the PC slabs in slab areas, and connection concrete is cast at a construction site such that the connection reinforcing bars of the PC wall members and the open reinforcing bars of the PC slab members are embedded in the connection concrete, thus integrating the PC walls and the PC slabs with each other through the connection concrete in the slab areas.

2. The structure constructed using the PC members according to claim 1, wherein the connection reinforcing bars comprise upper and lower connection reinforcing bars, which horizontally protrude outwards from each of the PC wall members and are arranged in a widthwise direction, wherein each of the upper connection reinforcing bars has on an end thereof a bent part, which is bent downwards to have a hook shape.

3. The structure constructed using the PC members according to claim 1, wherein the connection reinforcing bars comprise upper and lower connection reinforcing bars, which horizontally protrude outwards from each of the PC wall members and are arranged in a widthwise direction, wherein each of the upper and lower connection reinforcing bars has on an end thereof a bent part, which is bent at a right angle.

4. The structure constructed using the PC members according to claim 1, wherein each of the PC wall members has therein a plurality of bolt holes at positions just below the connection reinforcing bars such that the supporting molds are mounted to the PC wall member by bolting.

5. The structure constructed using the PC members according to claim 4, wherein an internal thread for bolting is formed in each of the bolt holes.

6. The structure constructed using the PC members according to claim 1, wherein the connection reinforcing bars comprise stud bars, which protrude from an outer surface of the PC wall member below a position at which the corresponding PC slab member is coupled to the PC wall member.

7. The structure constructed using the PC members according to claim 1, wherein each of the PC wall members comprises an iron wall connection frame.

8. The structure constructed using the PC members according to claim 7, wherein the iron wall connection frame comprises a planar iron plate, which is integrally provided along edge surfaces of the wall PC member.

9. The structure constructed using the PC members according to claim 7, wherein the iron wall connection frame comprises a planar iron plate, which is integrally provided along edge surfaces of the wall PC member, and locking holes are formed through a part of the planar iron plate, which corresponds to each of depressions formed in the edge surfaces of the PC wall member, at respective opposite positions with respect to a lateral direction of the planar iron plate, so that locking bolts are tightened into the respective locking holes.

10. The structure constructed using the PC members according to claim 7, wherein the iron wall connection frame comprises a tension steel wire, which is inserted through cross-sections of the PC wall members in a widthwise direction and is tightened at opposite ends thereof by tightening nuts.

11. The structure constructed using the PC members according to claim 1, wherein the open reinforcing bars comprise upper and lower open reinforcing bars, which are partially embedded in a cross-section of the PC slab member such that longitudinal opposite ends thereof are exposed from the longitudinal opposite edge surfaces of the PC slab member and are arranged in widthwise directions, wherein one of the upper and lower open reinforcing bars has on the end thereof a bent part, which is bent downwards to have a hook shape.

12. The structure constructed using the PC members according to claim 1, wherein the open reinforcing bars comprise upper and lower open reinforcing bars, which are partially embedded in a cross-section of the PC slab member such that longitudinal opposite ends thereof are exposed from the longitudinal opposite edge surfaces of the PC slab member and are arranged in widthwise directions, wherein each of the upper and lower open reinforcing bars has on the end thereof a bent part, which is bent at a right angle.

13. The structure constructed using the PC members according to claim 1, wherein the open reinforcing bars comprise upper and lower open reinforcing bars, which are partially embedded in a cross-section of the PC slab member such that longitudinal opposite ends thereof are exposed from the longitudinal opposite edge surfaces of the PC slab member and are arranged in widthwise directions, wherein the upper open reinforcing bars are linearly oriented in horizontal directions, and some of the lower open reinforcing bars are bent upwards.

14. The structure constructed using the PC members according to claim 1, wherein each of the PC slab members comprises an iron slab connection frame.

15. The structure constructed using the PC members according to claim 14, wherein the iron slab connection frame comprises planar iron plates, which are integrally provided on respective edge surfaces of each of the PC slab members that are opposite each other in the widthwise direction.

16. The structure constructed using the PC members according to claim 14, wherein the iron slab connection frame comprises planar iron plates, which are integrally provided on respective edge surfaces of each of the PC slab members that are opposite each other in the widthwise direction, and locking holes are formed through a part of each of the planar iron plates, which corresponds to each of depressions formed in the edge surfaces of the PC slab member that are opposite each other in the widthwise direction, at respective upper and lower positions with respect to a lateral direction of the planar iron plate, so that locking bolts are tightened into the respective locking holes.

17. The structure constructed using the PC members according to claim 14, wherein the iron slab connection frame comprises a tension steel wire, which is inserted through cross-sections of the PC slab members in a widthwise direction and is tightened at the opposite ends thereof by tightening nuts.

18. The structure constructed using the PC members according to claim 1, wherein each of the PC slab members has, on opposite ends thereof in the longitudinal direction, stepped parts, in each of which an upper part thereof protrudes outwards and a lower part thereof is depressed.

19. The structure constructed using the PC members according to claim 1, wherein each of the PC slab members has, on opposite ends thereof in the longitudinal direction, inclined parts, each of which is inclined downwards.

20. The structure constructed using the PC members according to claim 1, wherein each of the PC slab members has, on opposite ends thereof in the longitudinal direction, staggered end parts, in each of which an upper part thereof protrudes outwards, a middle part thereof is inclined downwards, and a lower part thereof is depressed.

21. The structure constructed using the PC members according to claim 1, wherein each of the supporting molds comprises: a plurality of support members, each having a mounting plate in contact with the corresponding PC wall member, the mounting plate having through holes therein, a support plate extending from the mounting plate in a perpendicular direction, and an inclined propping plate for supporting the support plate; and a mold panel seated onto the support plates of the support members, the mold panel having a plate shape, which is narrow and long, with longitudinal rods provided under a lower surface of the mold panel on opposite sides of a longitudinal axis of the mold panel.

22. The structure constructed using the PC members according to claim 21, wherein the supporting mold further comprises: a pair of holding pieces provided on the support plate of each of the support members, so that one of the longitudinal rods of the mold panel is inserted into and held by the holding pieces of the support members.

23. A method of constructing a structure using PC members through a process of forming PC walls using PC wall members, which are placed upright at predetermined positions, and of forming PC slabs for partitioning floors using PC slab members, which are horizontally provided between the PC wall members of the PC walls, the method comprising:

a PC wall constructing step of consecutively placing upright the PC wall members, each having a plurality of connection reinforcing bars, which horizontally protrude from the PC wall member at a position at which the corresponding PC slab member is coupled to the PC wall member, thus forming the PC walls;

a support mold mounting step of removably mounting supporting molds to the PC walls at positions just below the connection reinforcing bars protruding from the PC wall members;

a PC slab constructing step of placing the PC slab members, each having open reinforcing bars that are shorter than a distance between the adjacent PC walls and protrude from opposite edge surfaces of the PC slab members, on the corresponding supporting molds, such that the open reinforcing bars of the PC slab members are overlapped with the corresponding connection reinforcing bars of the PC wall members in slab areas, thus forming the PC slabs; and a connection concrete forming step of casting connection concrete at a construction site such that the connection reinforcing bars of the PC wall members of the PC walls and the open reinforcing bars of the PC slab members of the PC slabs are embedded in the connection concrete in the overlapped state, so that the PC walls and the PC slabs are integrated with each other in the slab areas through the connection concrete.

* * * * *